US008858410B2

(12) United States Patent
Piane, Jr.

(10) Patent No.: US 8,858,410 B2
(45) Date of Patent: Oct. 14, 2014

(54) MULTI-DIRECTIONAL BODY SWING TRAINER WITH INTERCHANGEABLE AND ADJUSTABLE ATTACHMENTS

(75) Inventor: Robert A. Piane, Jr., Newark, DE (US)

(73) Assignee: BVP Holding, Inc., Newark, DE (US)

( * ) Notice: Subject to any disclaimer, the term of this patent is extended or adjusted under 35 U.S.C. 154(b) by 949 days.

(21) Appl. No.: 13/004,022

(22) Filed: Jan. 10, 2011

(65) Prior Publication Data

US 2011/0172071 A1 Jul. 14, 2011

Related U.S. Application Data

(60) Continuation-in-part of application No. 12/785,658, filed on May 24, 2010, now Pat. No. 7,914,428, which is a division of application No. 12/287,731, filed on Oct. 14, 2008, now Pat. No. 7,722,514.

(60) Provisional application No. 61/293,234, filed on Jan. 8, 2010, provisional application No. 61/367,538, filed on Jul. 26, 2010.

(51) Int. Cl.
*A63B 21/00* (2006.01)

(52) U.S. Cl.
USPC ..... 482/143; 482/66; 482/70; 482/907

(58) Field of Classification Search
USPC ..... 482/143, 15, 66, 67, 69, 70, 72, 907
See application file for complete search history.

(56) References Cited

U.S. PATENT DOCUMENTS

| | | | | |
|---|---|---|---|---|
| 2,977,118 | A | 3/1961 | Farkas | 482/35 |
| 5,330,398 | A | 7/1994 | Barbafieri et al. | 482/23 |
| 5,403,253 | A | 4/1995 | Gaylord | 482/43 |
| 5,518,470 | A | 5/1996 | Piaget et al. | 482/51 |
| 5,518,476 | A | 5/1996 | McLeon | 482/79 |
| 6,117,052 | A | 9/2000 | Frost et al. | 482/52 |
| 7,217,225 | B2 | 5/2007 | Husted et al. | 482/51 |
| 7,722,514 | B2 | 5/2010 | Paine, Jr. | 482/143 |
| 7,837,569 | B2 * | 11/2010 | Ouellet | 472/118 |
| 7,892,101 | B1 * | 2/2011 | Weisz et al. | 472/118 |
| 2008/0004163 | A1 | 1/2008 | Husted et al. | 482/57 |
| 2009/0017928 | A1 * | 1/2009 | Tidmarsh et al. | 472/118 |
| 2009/0036226 | A1 * | 2/2009 | Bedashyov | 472/137 |

* cited by examiner

*Primary Examiner* — Glenn Richman
(74) *Attorney, Agent, or Firm* — Karl F. Milde, Jr.; Eckert Seamans Cherin & Mellott, LLC

(57) ABSTRACT

An exercise apparatus for providing multi-directional training to the body of a user is disclosed. The exercise apparatus allows the user to exercise the mid-section, hips, legs, ankles and connective tissues enjoining all the muscles in these areas. The exercise apparatus comprises a support, two foot platforms, and means for attaching the foot platforms to the support. The exercise apparatus is designed to be free standing or to be mounted onto other supporting structures. The apparatus has multiple interchangeable parts, attachments and accessories for allowing several types of exercises.

77 Claims, 40 Drawing Sheets

MULTI-DIRECTIONAL BODY SWING TRAINER WITH INTERCHANGEABLE AND ADJUSTABLE ATTACHMENTS

CROSS-REFERENCE TO RELATED APPLICATIONS

This application is based upon U.S. provisional patent application Ser. No. 61/293,234, filed Jan. 8, 2010, and U.S. provisional patent application Ser. No. 61/367,538, filed Jul. 26, 2010, and is a continuation-in-part of U.S. patent application Ser. No. 12/785,658, filed May 24, 2010 now U.S. Pat. No. 7,914,428, which in turn is a divisional of U.S. patent application Ser. No. 12/287,731, filed Oct. 14, 2008, now U.S. Pat. No. 7,722,514, each of which is incorporated herein by reference in its entirety.

FIELD OF INVENTION

The present invention relates to an exercise apparatus and more specifically to a multi-attachment exercise apparatus with interchangeable and adjustable parts for multi-directional training of the user.

BACKGROUND OF THE INVENTION

The human body moves in multi-planar directions and incorporates a multitude of muscles all working in combination simultaneously in almost all aspects of life. Strength, mobility, flexibility, cardio-conditioning, balance, muscle awareness, and coordination are all important during daily life, particularly in the area of sports conditioning and movement but also in normal human activities found in everyday life, such as loading groceries into a car, walking the dog on a slippery sidewalk in the snow, raking leaves, etc. Existing exercise devices do not allow the user to train all these aspects simultaneously even though we live in a world that requires such skills.

Existing swing training fitness devices are designed to simulate the walking patterns of a user. They are limited in their functionality and are usually fixed in a single use design. They swing forward and backward in an arced path, with the user standing on two pedals attached to two solid bars with a pivot point at about waist height and usually with the other end of each bar above the pivot point for the user to hold onto. As the user swings each leg alternatively forward and backward, the user's legs simulate a walking pattern. Such a device can be used for a cardio exercise, but it provides very limited strength to the user. Exercises particularly in the mid-section, hips, legs, ankles, and the connective tissues enjoining all of muscles in these areas are not provided by the existing fitness devices. Further, the training and coordination of the lower body in conjunction with the upper body is not served by these products.

SUMMARY OF THE INVENTION

The purpose of the present invention is to provide an exercise apparatus for allowing multi-planar and multi-directional training to the body of a user, wherein the exercise apparatus comprises a main frame, a plurality of foot platforms, and means for attaching the foot platforms to the main frame. The main frame further comprises a holding bar and a plurality of support bars. The main frame may be supported by a stand or a rigid surface.

It is an object of the present invention to provide an exercise apparatus which allows a user to exercise mid-section, hips, legs, ankles, and the connective tissues enjoining all of the muscles in these areas.

It is further an object of the present invention to provide an exercise apparatus to allow for training and coordination of the mid-section, hips, legs, ankles with the upper body of the user for better strength, mobility, flexibility, cardio-conditioning, balance, muscle awareness, and coordination.

It is further an object of the present invention to provide an exercise apparatus to allow rotational and multi-directional ankle training.

It is further an object of the present invention to provide an exercise apparatus which can be mounted on devices having attachment means and a supporting frame.

It is further an object of the present invention to provide a stand or support upon which an exercise apparatus can be mounted, thereby making it a stand-alone product.

It is further an object of the present invention to provide an exercise apparatus which has multiple interchangeable parts, attachments, and accessories allowing for various upper and lower body applications to be performed.

These objects, as well as other objects which will become apparent from the discussion that follows, are achieved, in accordance with the present invention.

In one embodiment of the invention, an exercise apparatus for training the body of a user in multi-directional patterns, comprises:

- a support including two or more connecting points;
- two elongate foot platforms adapted to be attached to and hang from said connecting points in substantially parallel side by side arrangement, each of said foot platforms being adapted for movement in a substantially horizontal X-Y plane with at least two degrees of freedom; and
- at least one elongate hanging member, connecting each of said foot platforms to at least one of said connecting points on said support, allowing said movement of said foot platforms in said X-Y plane with said at least two degrees of freedom.

In another embodiment of the invention, one or both foot platforms each have a vibratory mechanism to vibrate the bottom of a user's foot.

In another embodiment of an exercise apparatus of the invention, a controller is positioned on the support, and frequency and duration of vibration are controlled by the controller.

In another embodiment of an exercise apparatus of the invention, the at least one hanging member is adjustable in length.

In another embodiment of an exercise apparatus of the invention, the exercise apparatus further comprises at least one connecting member extending from one foot platform to the other foot platform.

In another embodiment of an exercise apparatus of the invention, at least one connecting member is elastic, non-elastic, or a combination thereof.

In another embodiment of an exercise apparatus of the invention, the exercise apparatus comprises two hanging members for attaching opposite sides of each foot platform to said support.

In another embodiment of an exercise apparatus of the invention, the hanging member is a tension element selected from the group consisting of a chain, a band, a rod, a tube, a strap, a cable and a combination of at least two such tension elements.

In another embodiment of an exercise apparatus of the invention, the tension element is non-elastic.

In another embodiment of an exercise apparatus of the invention, at least a portion of the tension element is elastic, thereby supporting the foot platform with a third degree of freedom.

In another embodiment of an exercise apparatus of the invention, the tension element is flexible.

In another embodiment of an exercise apparatus of the invention, the support is substantially C-shaped and arranged in a substantially horizontal plane.

In another embodiment of an exercise apparatus of the invention, the support comprises two substantially U-shaped sections arranged in a substantially horizontal plane.

In another embodiment of an exercise apparatus of the invention, the support is substantially vertical.

In another embodiment of an exercise apparatus of the invention, a hanging member for attaching the foot platform to the support comprising a holding bar which has a ring at one end adapted to slide over the support to form a connecting point.

In another embodiment of an exercise apparatus of the invention, a hanging member for attaching the foot platform to the support has a clip at one end for attachment to the support at a connecting point.

In another embodiment of an exercise apparatus of the invention, a hanging member is easily detachable from the support.

In another embodiment of an exercise apparatus of the invention, the connecting points are adapted to attach at least one fitness accessory to the support.

In another embodiment of an exercise apparatus of the invention, the exercise apparatus further comprises an ankle training accessory, adapted to be attached to the foot platform.

In another embodiment of an exercise apparatus of the invention, the ankle training accessory is a circular pivot plate, a half ball, a rotatable disc, or a longitudinally extending member.

In another embodiment of an exercise apparatus of the invention, the foot platform is centrally attached to allow it to rock up and down, thereby providing ankle training.

In another embodiment of an exercise apparatus of the invention, an exercise apparatus described herein can be mounted on a stand or other structural support such as a wall mount or larger exercise apparatus.

In another embodiment of the invention, an exercise apparatus for training the body of a user in multi-directional patterns comprises:

a support including two or more connecting points and comprising two sections that can be separated, wherein one section of the support can be moved relative to the other section;

two foot platforms adapted to be attached to and hang from said connecting points in substantially parallel side by side arrangement, each of said foot platforms being adapted for movement in a substantially horizontal X-Y plane with at least two degrees of freedom; and at least one elongate hanging member, connecting each of said foot platforms to at least one of said connecting points on said support, allowing said movement of said foot platforms in said X-Y plane with said at least two degrees of freedom.

In another embodiment of the invention, an exercise apparatus for training the body of a user in multi-directional patterns comprises:

a support including two or more connecting points;

two elongate foot platforms adapted to be attached to and hang from said connection points in substantially parallel side by side arrangement, each of said foot platforms being adapted for movement in a substantially horizontal X-Y plane with at least two degrees of freedom;

at least one elongate hanging member, connecting each of said foot platforms to at least one of said connecting points on said support, allowing said movement of said foot platforms in said X-Y plane with said at least two degrees of freedom; and at least one limiter to limit the swinging or rotational movement of an upper portion of each hanging member.

In another embodiment of an exercise apparatus of the invention, the angle of rotation of the upper end of the hanging member is limited.

In another embodiment of an exercise apparatus of the invention, the limiter is mechanical, hydraulic, or electrical.

In another embodiment of an exercise apparatus of the invention, the hanging member is rigid or substantially rigid.

In another embodiment of the invention, an exercise apparatus for training the body of a user in multi-directional patterns comprises:

a support including two or more connecting points;

two elongate foot platforms adapted to be attached to and hang from said connecting points in substantially parallel side by side arrangement, each of said foot platforms being adapted for movement in a substantially horizontal X-Y plane with at least two degrees of freedom and wherein said foot platforms each have multi-directional wheels, rollers, or castors to support the foot platform; and at least one elongate hanging member, connecting each of said foot platforms to at least one of said connecting points on said support, allowing said movement of said foot platforms in said X-Y plane with said at least two degrees of freedom.

In another embodiment of the invention, an exercise apparatus for training the body of a user in multi-directional patterns comprises:

a support including two or more connecting points;

two elongate foot platforms adapted to be attached to and hang from said connecting points in substantially parallel side by side arrangement, each of said foot platforms being adapted for movement in a substantially horizontal X-Y plane with at least two degrees of freedom and wherein said foot platforms each have multi-directional wheels, rollers, or castors to support the foot platform;

at least one elongate hanging member, connecting each of said foot platforms to at least one of said connecting points on said support, allowing said movement of said foot platforms in said X-Y plane with said at least two degrees of freedom; and a base comprising at least one contoured surface upon which the wheels of the foot platforms can move with at least two degrees of freedom.

In another embodiment of an exercise apparatus of the invention, the base comprises two or more sections that fit together.

In another embodiment of an exercise apparatus of the invention, the contoured surfaces form an upwardly turned saucer shape.

In another embodiment of an exercise apparatus of the invention, the contoured surfaces form a pipeline shape.

In another embodiment of the invention, an exercise apparatus for training the body of a user in multi-directional patterns comprises:

a support for a user to grip; and a base comprising at least two longitudinally extending members, foot platforms, and support members supporting the foot platforms and being slidable within or on the longitudinally extending members, wherein the foot platforms are slidable substantially horizontally on the support members, to provide at least two degrees of freedom.

In another embodiment of the invention, an exercise apparatus for training the body of a user in multi-directional patterns comprises:

a support for a user to grip; and a base comprising at least two longitudinally extending members, foot platforms, and support members supporting the foot platforms and being slidable within or on the longitudinally extending members, wherein the foot platforms are slidable substantially horizontally on the support members, to provide at least two degrees of freedom.

In another embodiment of the invention, an exercise apparatus for training the body of a user in multi-directional patterns comprises:

a base comprising at least two longitudinally extending members, foot platforms, and support members supporting the foot platforms and being slidable within or on the longitudinally extending members, wherein the foot platforms are slidable substantially horizontally on the support members, to provide at least two degrees of freedom.

In another embodiment of an exercise apparatus of the invention, three longitudinally extending members extend longitudinally.

In another embodiment of an exercise apparatus of the invention, two longitudinally extending members extend laterally.

In another embodiment of an exercise apparatus of the invention, each longitudinally extending member comprises two sections that have a hinge connector.

In another embodiment of an exercise apparatus of the invention, each section has means for raising or lowering the section.

In another embodiment of an exercise apparatus of the invention, each section has a concave upper surface.

In another embodiment of the invention, an exercise apparatus for training the body of a user in multi-directional patterns comprises:

a support including two or more connecting points;

two elongate foot platforms adapted to be attached to and hang from said connecting points in substantially parallel side by side arrangement, each of said foot platforms being adapted for movement in a substantially horizontal X-Y plane with at least two degrees of freedom; and at least one elongate hanging member, connecting each of said foot platforms to at least one of said connecting points on said support, allowing said movement of said foot platforms in said X-Y plane with said at least two degrees of freedom.

In another embodiment of the invention, in an improved exercise apparatus comprising foot platforms suspended from a support bar, the improvement for training the body of a user in multi-directional patterns, which comprises:

support including two or more connecting points;

two elongate foot platforms adapted to be attached to and hang from said connecting points in substantially parallel side by side arrangement, each of said foot platforms being adapted for movement in a substantially horizontal X-Y plane with at least two degrees of freedom; and at least one elongate hanging member, connecting each of said foot platforms to at least one of said connecting points on said support, allowing said movement of said foot platforms in said X-Y plane with said at least two degrees of freedom.

The foregoing and other objects, features and advantages of the invention will be apparent from the following more particular description of the invention as illustrated in the accompanying drawings.

BRIEF DESCRIPTION OF THE DRAWINGS

FIG. 1, comprising

FIG. 2, comprising

FIG. 4, comprising

FIG. 5, comprising

FIG. 6, comprising

FIG. 7, comprising

FIG. 10, comprising

FIG. 13, comprising

DETAILED DESCRIPTION OF THE INVENTION

Figure 1A:
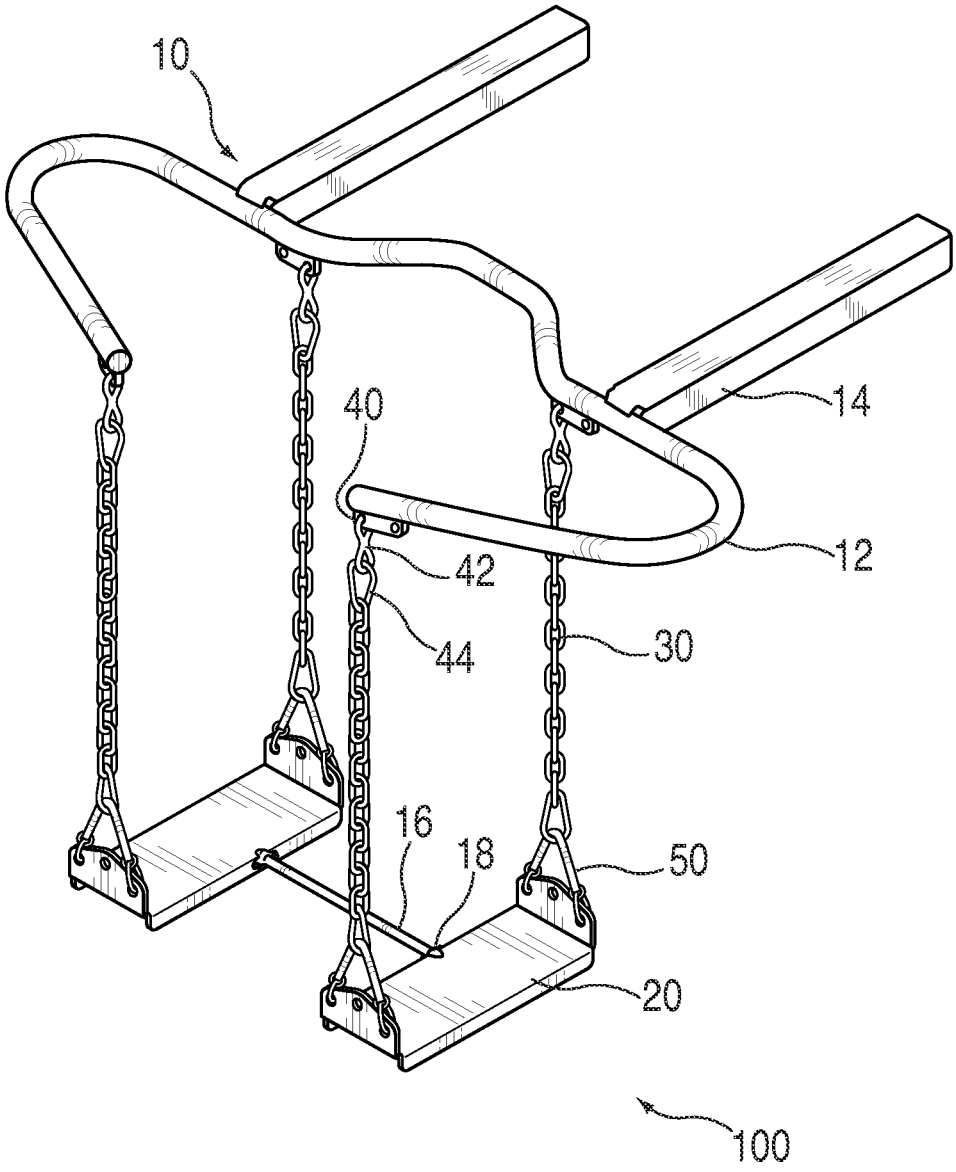
FIGS. 1*a*-1*d*, depicts an exercise apparatus 100 with its basic parts.

The preferred embodiments of the present invention will now be described with reference to FIGS. 1-21 of the drawings. Identical elements in the various figures are designated with the same reference numerals.

Embodiments of the present invention provide an exercise apparatus for multi-directional and multi-planar training of the body of the user. In the description of the present invention, numerous specific details are provided, such as examples of components and/or mechanisms, to provide a thorough understanding of the various embodiments of the present invention. One skilled in the relevant art will recognize, however, that an embodiment of the present invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

FIG. 1*a* illustrates an exercise apparatus 100 along with its various parts. The exercise apparatus 100 consists of a main frame 10 which supports foot platforms 20 substantially in parallel by means of hanging members or elements 30, such as chains, cables, ropes, bands, or rods. The main frame 10 comprises a C-shaped holding bar 12 and support bars 14. The holding bar 12 of the main frame 10 is attached to the support bars 14. The user steps on the foot platforms 20 and holds the holding bar 12 when commencing a workout. The support bars 14 are adapted to be attached to a mounting support, such as a wall or floor, with the aid of mounting means. The mounting support can be a wall, or a separate stand, or any supporting frame such as a SUPERCELL™ exercise system available commercially from Vortex Fitness Equipment of Wilmington, Del.

Figure 14:
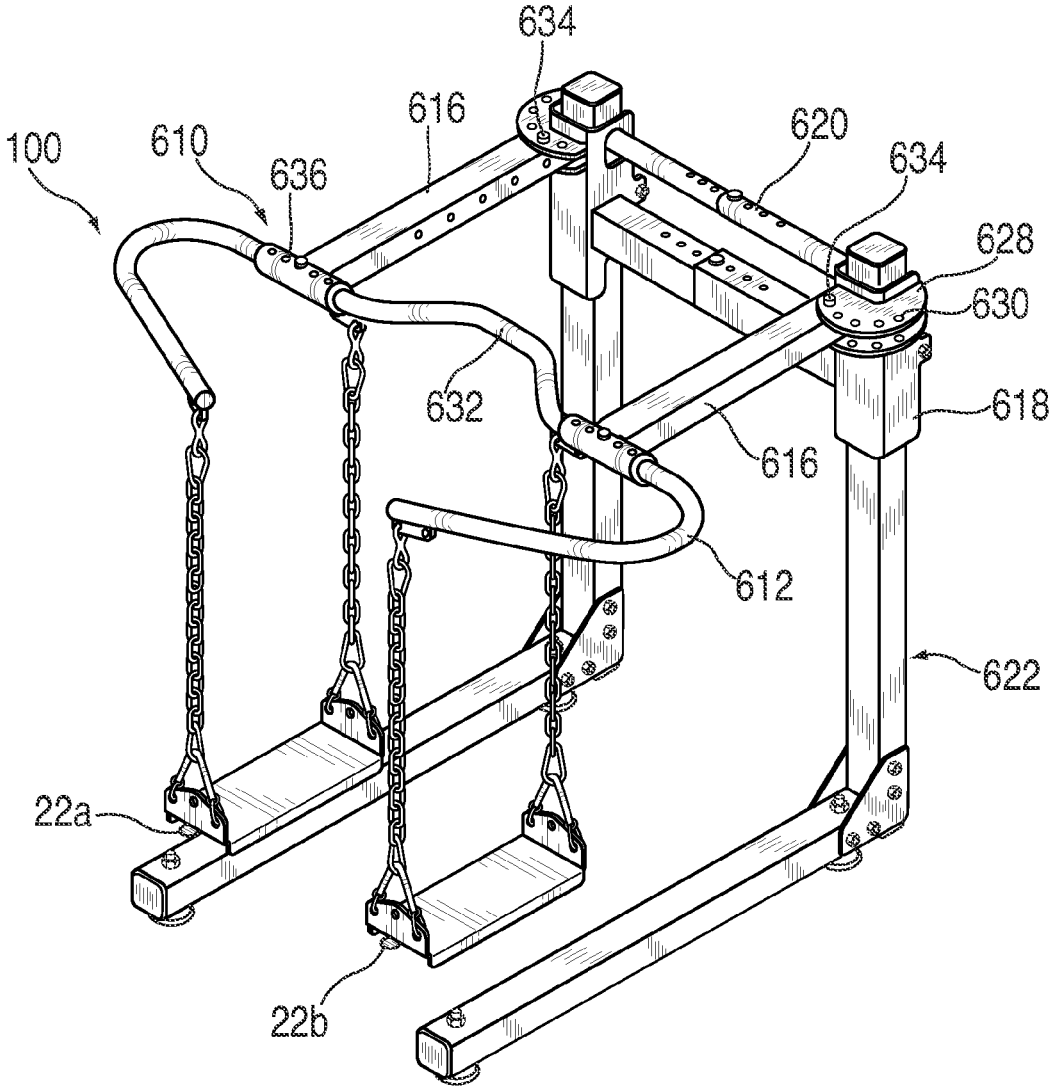
FIG. 14 depicts an embodiment of an exercise apparatus according to the invention where elements can be adjusted to accommodate users of different dimensions.

The hanging elements 30 used to attach the foot platforms 20 to the main frame 10 are adapted for moving in multiple directions, with two degrees of freedom in an X-Y plane, thereby allowing the user to train his/her body in multi-directional patterns for better strength, mobility, flexibility, cardio-conditioning, balance, muscle awareness and coordination. Multiple connection points 40 on the holding bar 12 permit adjustment of the distance between the foot platforms 20, and also permit the foot platforms 20 to be suspended at a slight angle (away from strictly parallel) to accommodate "pigeon toed" users and the like. Further, additional connection points 40 could be positioned vertically to raise or lower hanging elements 30 and/or to raise or lower ends of platforms 20, whereby the platforms 20 are raised, lowered, and/or tilted. Optionally, holding bar 12 can be rotatably held at the ends of support bars 14 with a mechanical arrangement, such as a pop pin arrangement, so that holding bar 12 can be tilted up or down and locked in position, as shown in FIG. 14.

The holding bar 12 has swivel snap hooks or clips 42 which are further attached to a carabiner 44 to lock the links of one end of the hanging elements 30. A snap hook or the carabiner 44 can be used to adjust the length of each respective hanging element 30. On the other end of the hanging elements 30, bungee cords or similar elastic members 50 can be attached to connect the hanging elements 30 to foot platforms 20. This gives the platform an additional degree of freedom of movement, in the vertical or "Z" direction, enabling the user to bounce up and down. Alternatively, non-elastic members 50 can be used to connect the foot platforms 20 to the hanging elements 30.

In another embodiment only the carabiner 44 can be used to lock the links of the hanging elements 30. The present invention contemplates the use of swivel snap hooks 42, whereas other types of hooks or connecting means can be used without altering the scope of the invention.

In an optional embodiment of the invention, to limit the relative spacing of platforms 20, at least one member 16, preferably one or two, extends between platforms 20. Each member 16 is attached to a platform 20 at an attachment point 18. A member 16 comprises elastic, for example, a spring or band, or non-elastic material of a length of from about 15 to about 45 cm.

Figure 1B:
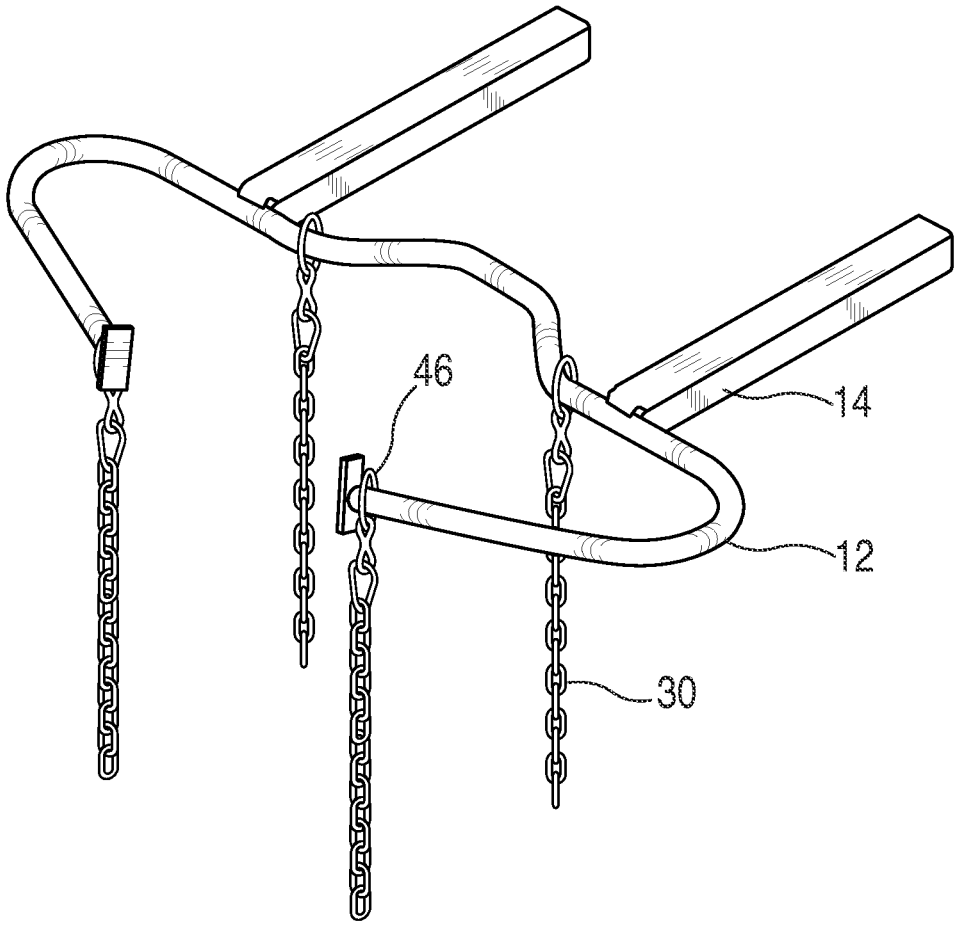

In another embodiment the hanging elements 30 are slidably attached to the main frame 10 as illustrated in FIG. 1*b*. Ring members 46 can be used to attach the hanging elements 30 to the holding bar 12, thereby allowing the user to adjust the points of attachment of the hanging elements 30 to the most comfortable position.

Figure 1C:
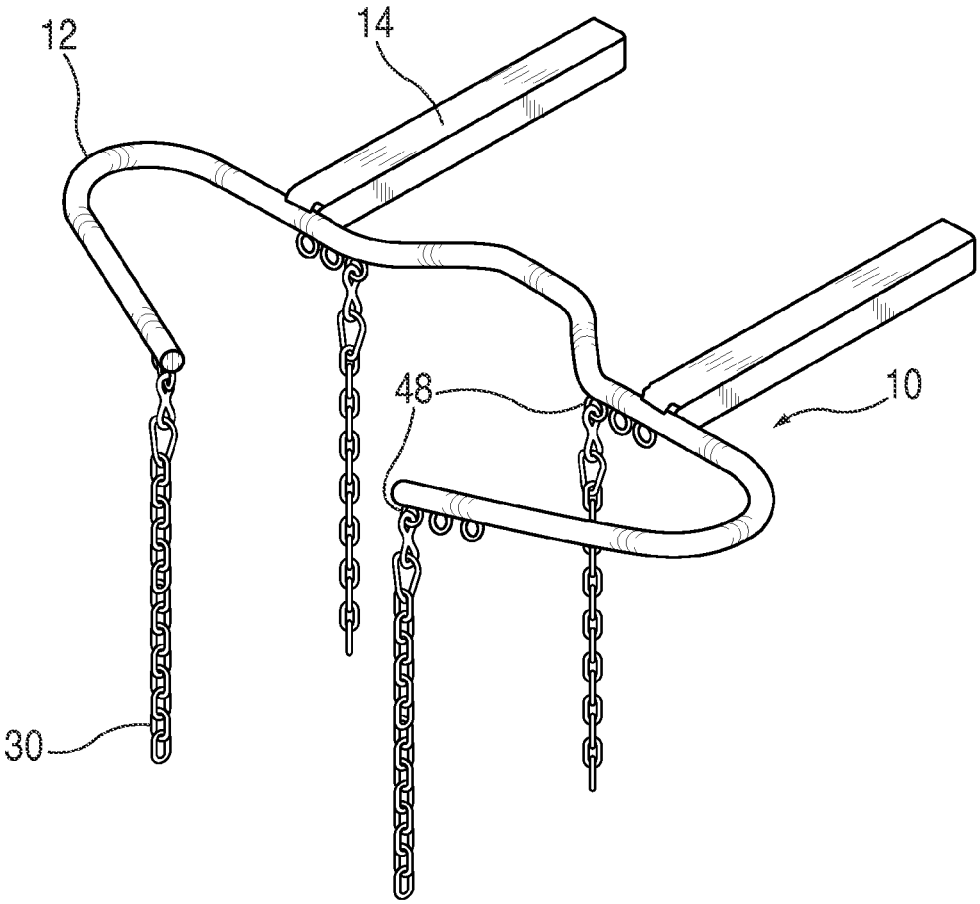

In still another embodiment, the holding bar 12 is provided with various connecting elements 48 to allow the user to attach the hanging elements 30 at specific points on the holding bar 12 as illustrated in FIG. 1*c*.

Figure 1D:
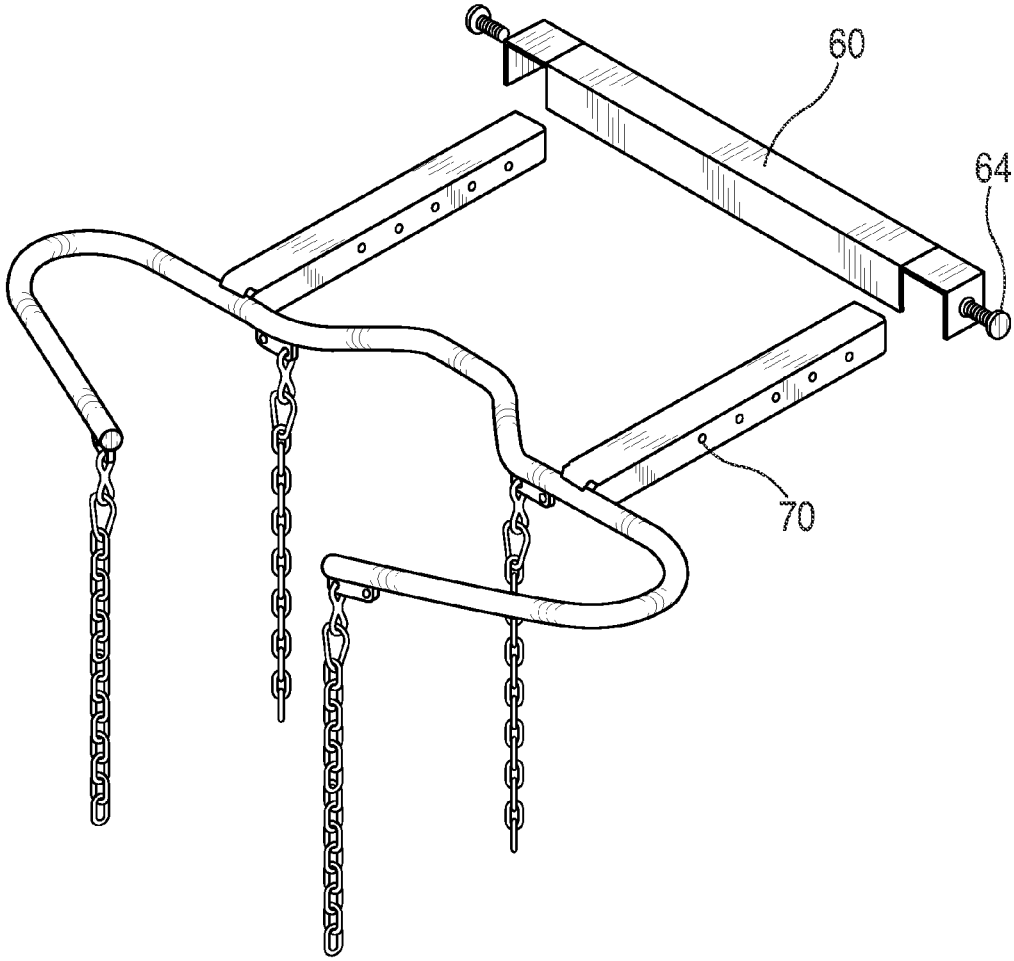

In still another embodiment, provisions 70 are made on the support bars 14 of the main frame 10 for accommodating crossbars 60 or similar structures as illustrated in FIG. 1*d*. The crossbars are affixed to the support bars by means of pop pins 64, or the like. Various accessories can be attached to the crossbars 60 to facilitate several types of workouts.

Figure 2A:
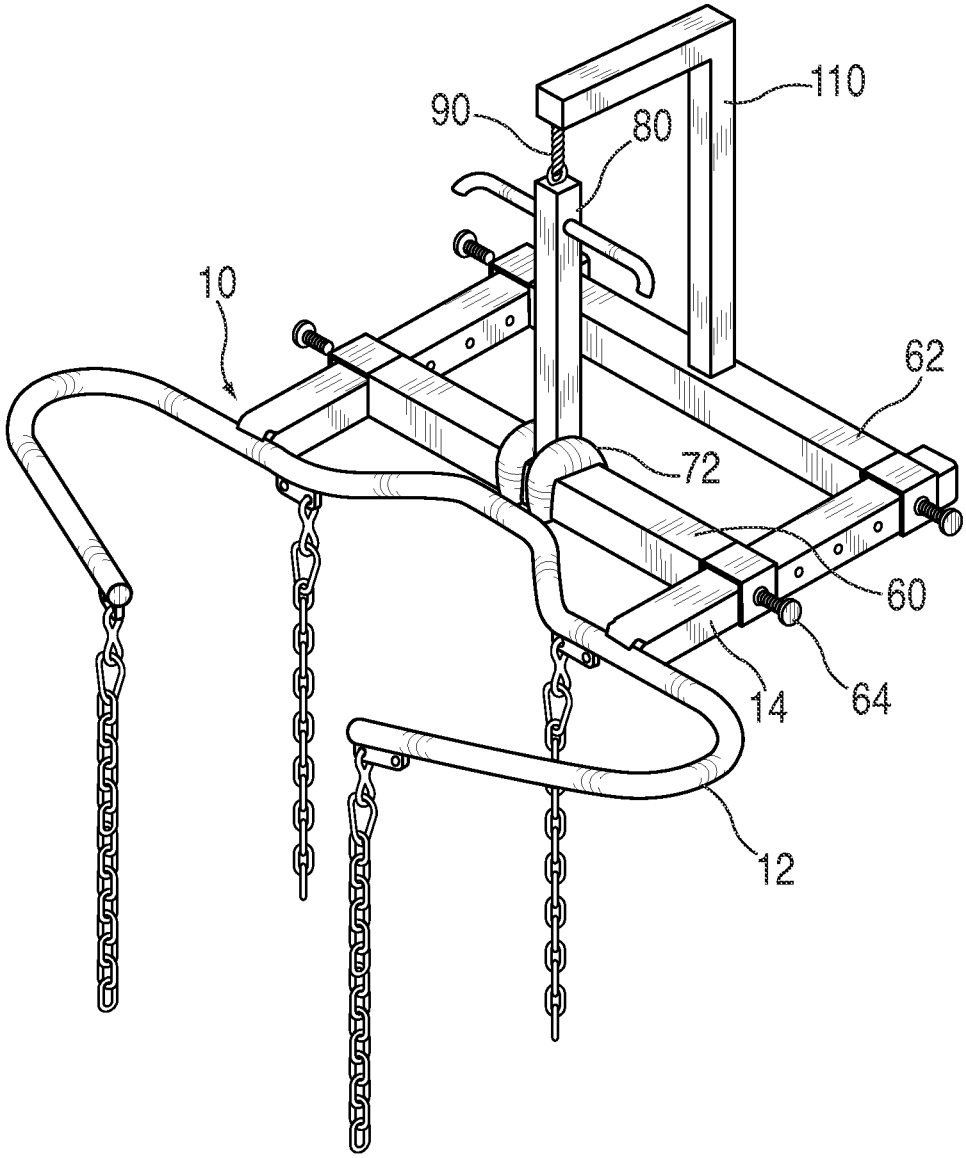
FIGS. 2*a* and 2*b*, depicts the exercise apparatus 100 with an attachment for upper body workout.

One such accessory can be a detachable device for upper body training as illustrated in FIG. 2*a*. This accessory allows the user to train the upper body either in unison or in isolation to the lower body. The attachment includes two horizontal handles mounted on an upright bar 80, the bottom end of which is pivotally mounted on a crossbar 60 fitted between the support bars 14 of the main frame 10. The bar 80 is lockable in a fixed upright position, or in any one of several different tilted positions, but when unlocked it can tilt freely in any direction. Bar 80 may end in a ball in socket 72 so that bar 80 can be rotated or pivoted in all directions.

Figure 2B:
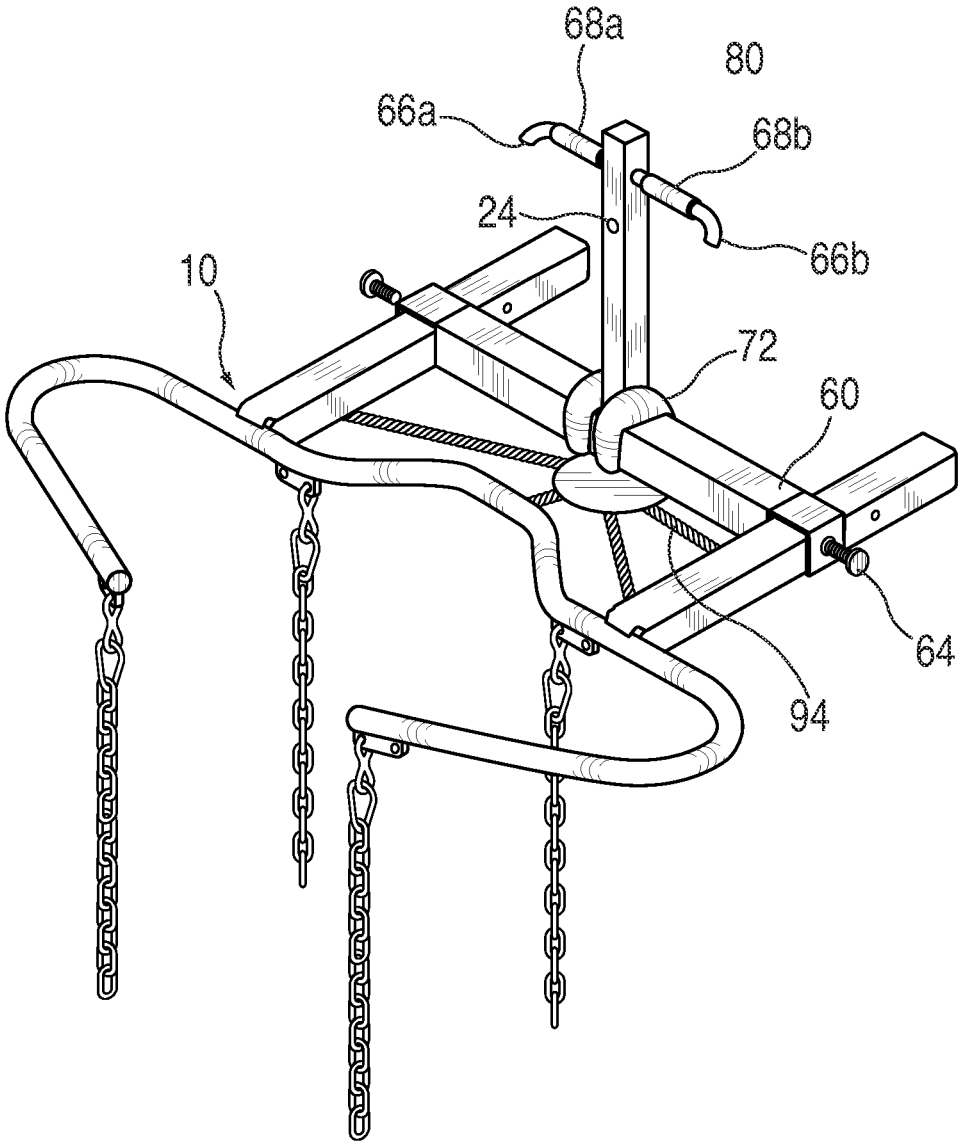

With the attachment shown in FIG. 2*a*, an elastic member 90 is used to provide resistance to tilting motion of the bar 80. One way of attaching an elastic member 90 is to connect it between the top end of the handle 80 and a post 110 attached to a second crossbar 62. Another way is to attach multiple elastic members 94 to the bottom of the bar 80 as shown in FIG. 2*b*. In this embodiment, one end of the elastic members is attached to the bottom end of the bar 80 and while the other end is attached at various points to the main frame 10. The bar 80, which is pivoted on the crossbar 60 and may end in a ball in socket 72, can be moved in any direction away from the vertical or can be rotated or twisted using the handles 66*a* and 66*b*; however, it is continually biased toward the upright position by the elastic members 94. As in the case of the embodiment of FIG. 2*a*, the bar 80 in the embodiment of FIG. 2*b* can be locked in the upright position, or in one of a number of different non-upright positions as selected by the user, to prevent tilting movement.

Optionally, bar 80 and socket 72 may have means to adjust pressure on the ball.

Figure 3:
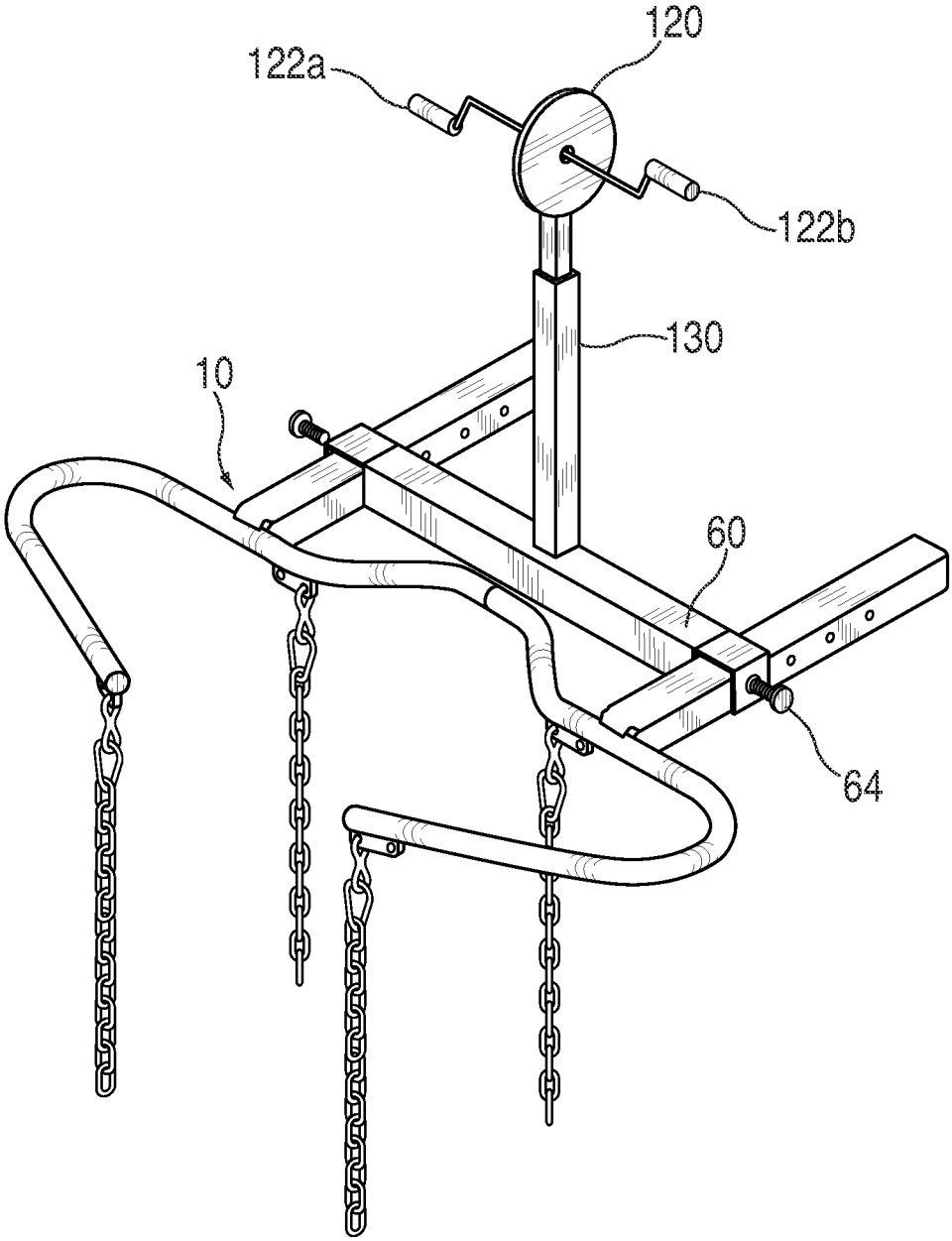
FIG. 3 depicts an upper body bicycle attachment for the exercise apparatus.

Another such upper body training accessory can be a detachable exercise bicycle device 120 with an adjustable resistance to facilitate an upper body workout of the user as illustrated in FIG. 3. The hand operated bicycle device 120 is mounted on a post 130 which is attached to the crossbar 60. When coupled to a device for measuring the energy expended by the user, this type of accessory is sometimes referred to as an "ergometer."

To provide information about the use of the exercise apparatus, a number of electronic sensors may be disposed at various points on the apparatus. For example, as shown in FIG. 2*b*, metal sensors 68*a* and 68*b* may be mounted on the handles 66*a* and 66*b*, respectively, to sense the heart rate of the user. A motion sensor 24 may be mounted on the movable bar 80 to sense the position, speed and/or acceleration of the bar.

On or more such motion sensors 122*a* and 122*b* may also be fitted to the hand-operated bicycle device, as shown in FIG. 3.

Figure 4A:
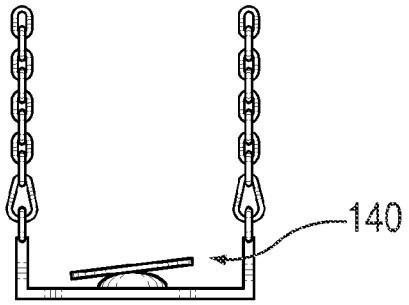
FIGS. 4*a*-4*d*, depicts various clip-ons for the foot platforms.
Figure 4B:
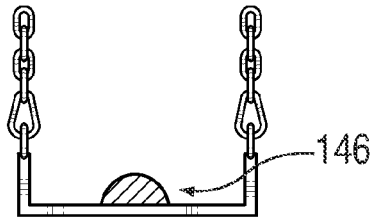
Figure 4C:
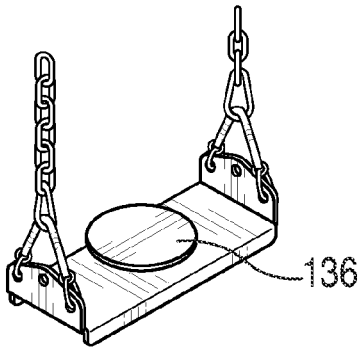

In still another embodiment of the invention, the foot platforms 20 are fitted with various accessories for ankle training in multiple directions. The accessory can be a pivotal circular plate 140 as shown in FIG. 4*a*. The accessory can also be a half ball 146 made up of a material such as rubber as shown in FIG. 4*b*. A rotatable disc 136 can also be used as an accessory for the foot platforms 20 for developing rotational strength of the ankle of user as shown in FIG. 4*c*. These accessories may be both attachable and detachable, so that the user can apply them to the foot platforms 20 whenever an ankle exercise is required.

Figure 4D:
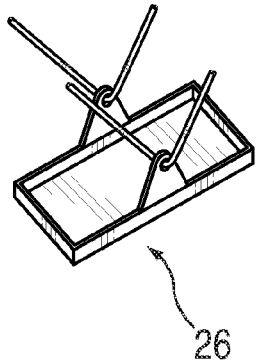

In still another embodiment of the invention, a foot platform 26 is pivoted centrally as shown in FIG. 4*d* so that the platform can rock up and down. This extra degree of freedom, in addition to the basic two degrees of freedom afforded the foot platform by the hanging elements 30, enables the user to perform ankle training.

Figure 5A:
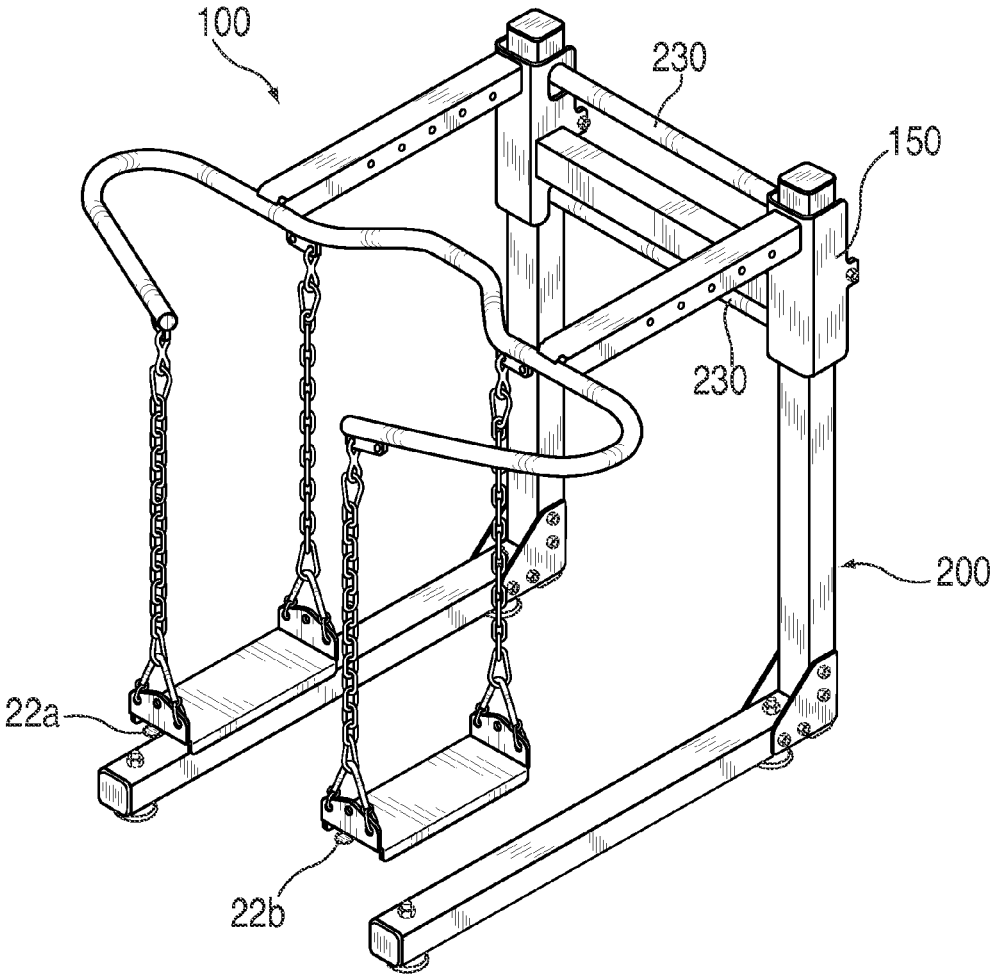
FIGS. 5*a*-5*e*, depicts an exercise apparatus and portions thereof.
Figure 5B:
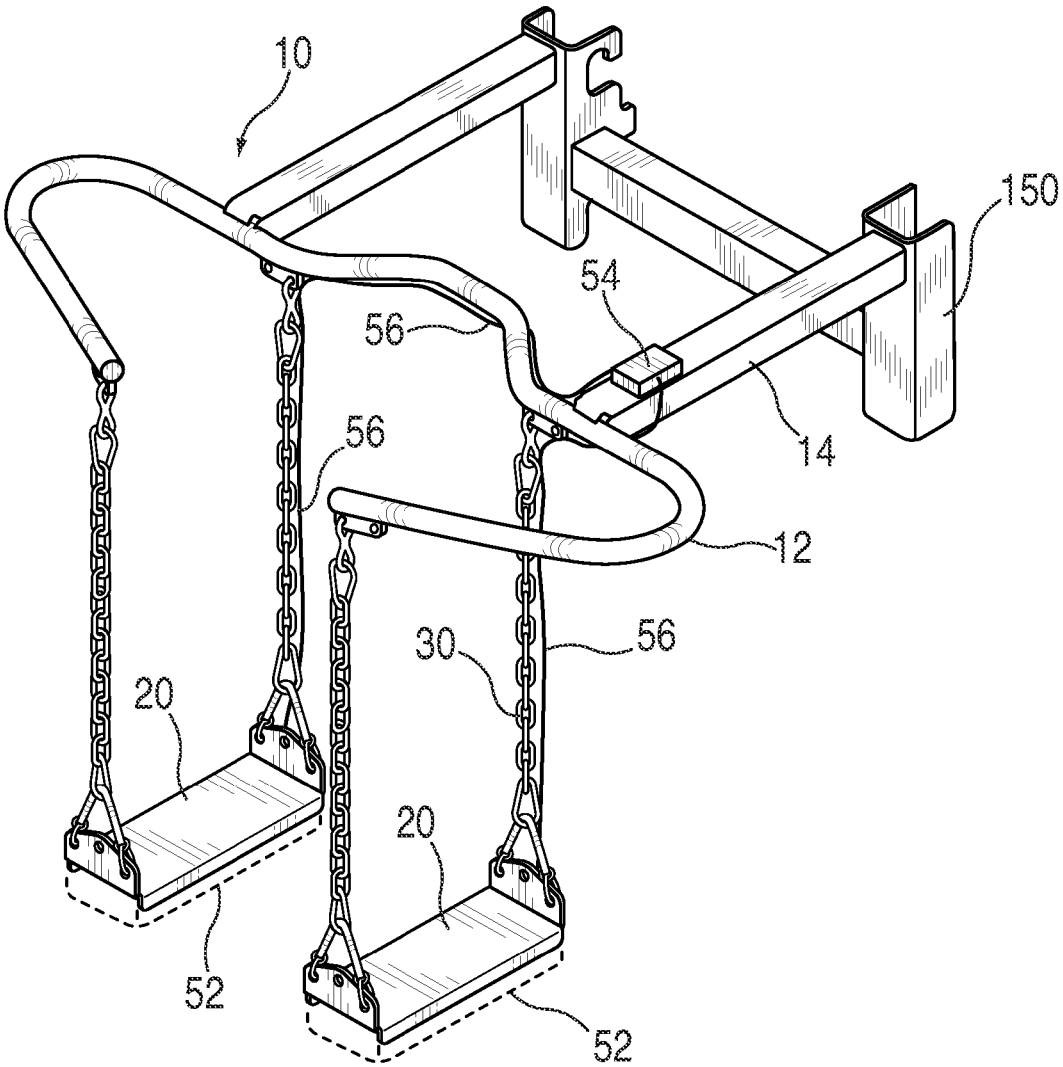

In still another embodiment of the invention, the exercise apparatus 100 is mounted on a stand 200 with crossbars 230 using a ladder hook-on assembly 150 thereby making it a stand-alone product as shown in FIG. 5*a*. The ladder hook-on assembly 150 is attached to the support bars 14 of the main frame 10 of the exercise apparatus 100 as shown in FIG. 5*b*. Ladder hook-on assembly 150 helps in adjusting the height and position of the exercise apparatus 100 and can be attached or detached from the stand 200 as well as from the exercise apparatus 100 with ease.

Motion sensors 22*a* and 22*b* can be provided on the foot platforms to sense the motion imparted by the user. These and the other sensors that may be provided on the exercise apparatus are connected to an electronic system (not shown) for processing and signals and providing an image display in response to these signals.

In FIG. 5*b* each platform 20 has a vibrator 52 attached thereto. The vibrators 52 communicate with a vibrator control 54, wirelessly or through wiring 56. Vibrators 52 may have batteries or may be connected to a power source (not shown).

Figure 5C:
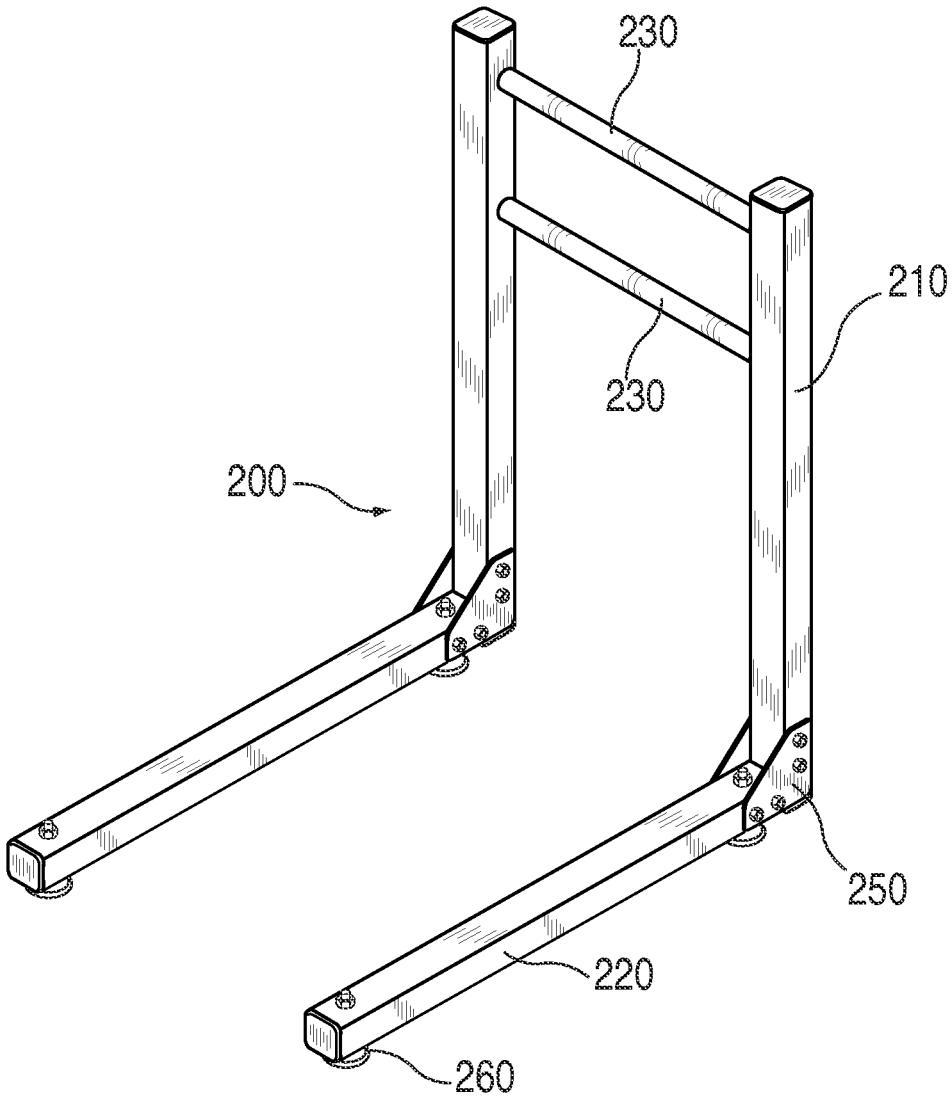
Figure 5D:
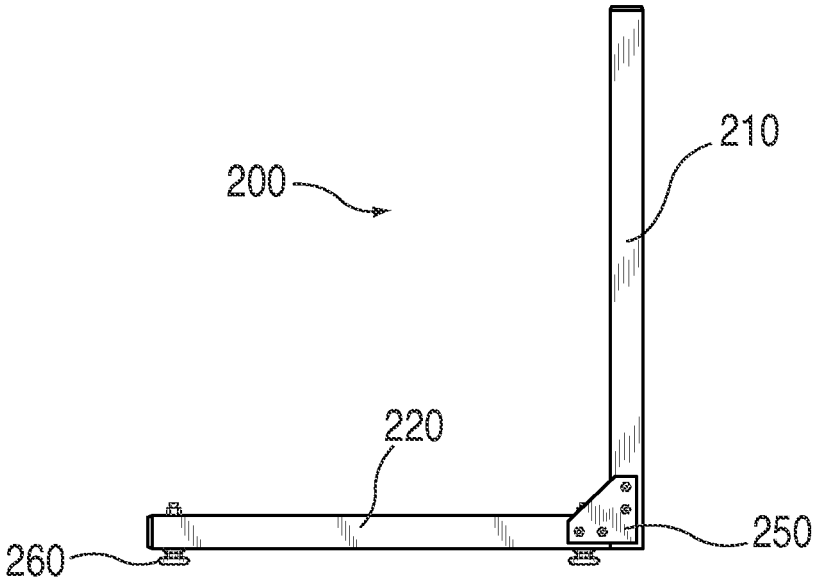
Figure 5E:
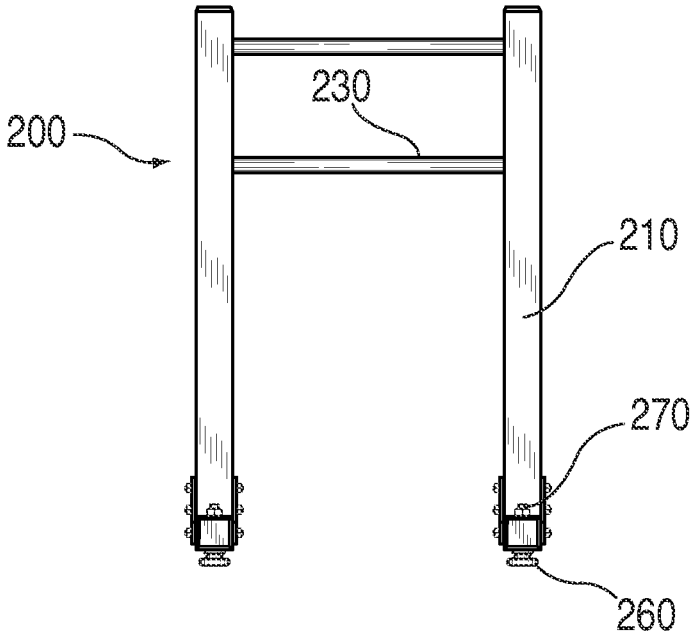

An exploded view of the stand 200 is illustrated in FIG. 5*c*. The stand 200 has vertical members 210 which are attached to each other by crossbar 230 forming a ladder-like frame structure. The vertical members 210 are attached to horizontal members 220 by well known means, such as gusset plates 250. The horizontal members 220 are provided with leveling feet 260 which can be adjusted to raise, lower, or tilt stand 200 as desired. The side view of the stand 200 as shown in FIG. 5*d* depicts the connection between the vertical members 210 and horizontal members 220 by the gusset plate 250 and the arrangement of the leveling feet 260 on the horizontal members 220. FIG. 5*e* depicts the use of hexagonal lock nuts 270 on the horizontal members 220 in attaching the feet 260.

The exercise apparatus 100 can optionally be mounted with ladder hook-on assembly 150 or another locking or mounting assembly on a wall or any supporting structure, such as a girder, a crossbeam, or another, larger exercise apparatus.

In still another embodiment of the invention, the exercise apparatus 100 can be adapted to be used by a physically challenged person. A person having a disabled leg can rest the disabled leg on a foot rest mounted on the apparatus and perform the exercise with the other leg. Also, the exercise apparatus can be designed to be used by a person in a wheelchair. The user can perform upper body exercise by attaching an add-on to the main frame 10. A locking device can be provided to lock the wheelchair of the user to avoid movement of the wheelchair while the user is performing the exercise. Various other alterations in the design of the equipment can be made to help a physically challenged person in performing several types of exercises without changing the scope of the invention.

In still another embodiment of the invention, one or more sensors can be disposed within the exercise apparatus 100. The sensors can be integrated with a screen display for interactive use. The sensors can also be used to sense the heartbeat rate or other body conditions of the user in order to display these conditions on a screen and to notify the user about his/her physical health status. Various other types of sensors, such as pulse sensor, heart rate sensor, motion sensor and/or the like can also be used for information transfer between the exercise device and the user.

In still another embodiment of the invention, the exercise apparatus 100 can be equipped with electricity generating means to convert the physical energy of the user into electrical energy. Generated electrical energy can be used to power the exercise apparatus 100, lighting of the exercise room, or the like.

While support bar 14 is preferably perpendicular to member 308 of ladder hook-up assembly 150, bar 14 can be rotatably positioned at an angle other than 90° by use of a plate 628 and pop pins 630, as shown in FIG. 14.

In another embodiment of the invention shown in FIGS. 6*a* to 6*d*, support members 290 are attached to a handle bar 292 and an attachment member 294, which attachment member 294 can be attached to a wall mount or a stand, such as stand 300. A platform support 302 is attached to each support member 290 at a pivot point 304.

Figure 6A:
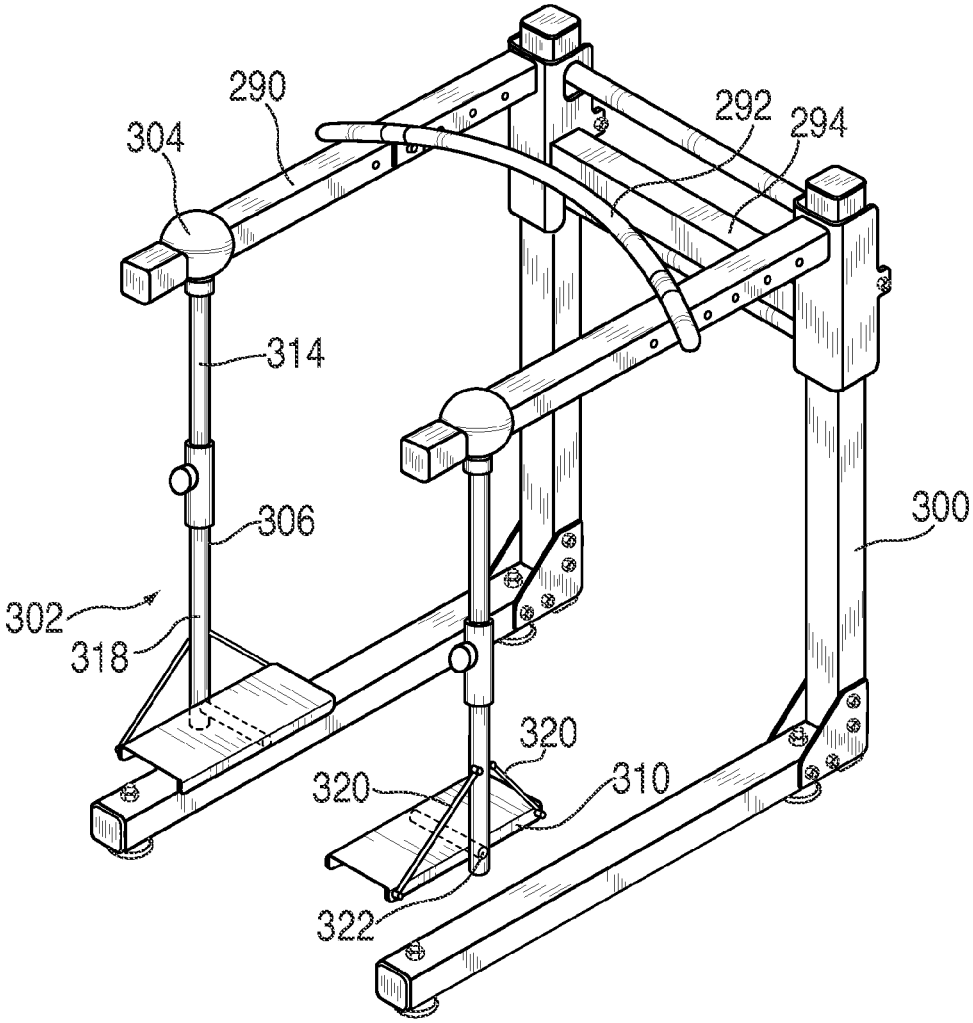
FIGS. 6*a*-6*d*, depicts another embodiment of an exercise apparatus according to the inventions.

Each platform support 302 comprises a longitudinally extending member or hanging member 306 and a foot platform 310. Hanging member 306 may comprise two or more adjustable elements. In FIG. 6*a*, upper section 314 and lower section 318 can be fixed in length or preferably they can be adjusted against each other to vary the height of a platform 310. Platform 310 is attached to the lower portion 318 of hanging member 306, and elastic bands 320 extend from hanging member 306 to the ends of platform 310.

Elastic bands 320 are attached to lower portion 318. Each foot platform 310 can pivot around pivot point 322.

Figure 6D:
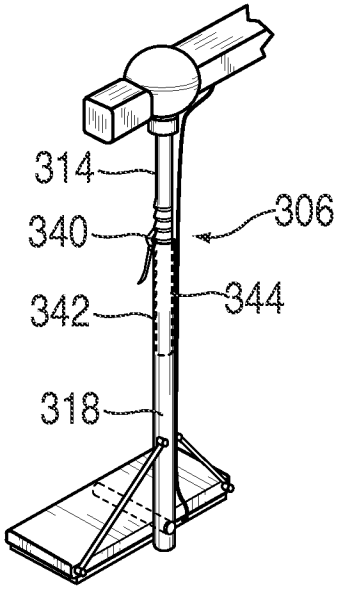
Figure 6C:
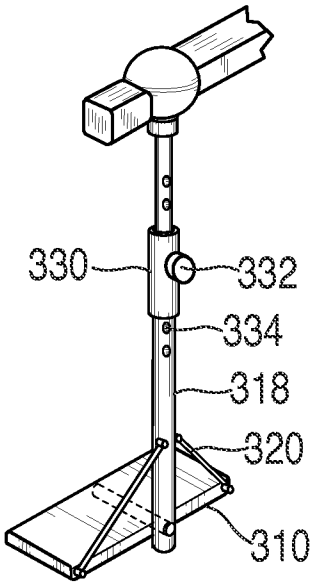
Figure 6B:
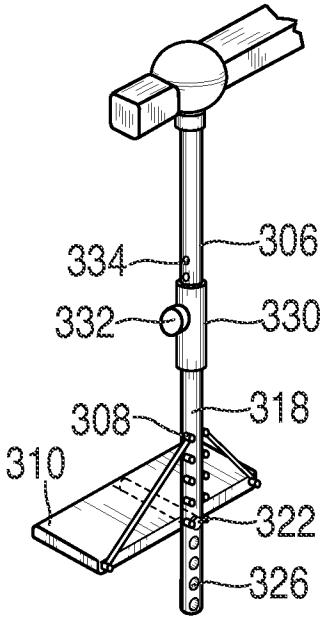

Variations of the portion of the invention shown in FIG. 6*a* are shown in FIGS. 6*b* and 6*c*. In FIG. 6*b*, hanging member 306 has holes 326 in lower section 318 to accommodate repositioning foot platform 322. Similarly, the lateral surfaces of hanging member 306 have hooks or similar means 308 to receive an end of an elastic band 320 as a foot platform 322 is repositioned.

In FIG. 6*c*, a foot platform 310 is pivotably positioned at the end of lower section 318, with elastic bands 320 fixedly attached to section 318. Upper section 316 and lower section 318 are adjustably joined at point 330, where, for example, one or more bolts or pop pins 332 engage reciprocal openings 334 in sections 314 and 318.

The aspect of the invention reflected in FIG. 6*d* comprises a hanging member 306 with a spring loaded lever 340, to secure the longitudinal relationship between sections 314 and 318. Sections 314 and 318 have engaging surfaces 342 and 344, respectively, which are held in position when lever 340 is released.

Figure 7A:
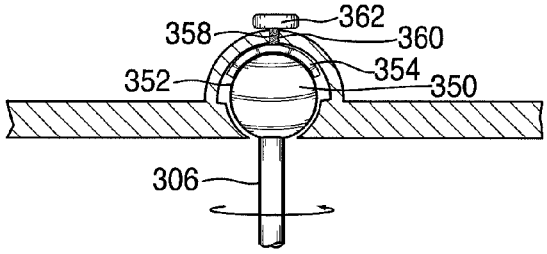
FIGS. 7*a*-7*i*, depicts pivot point structures that regulate resistance and limit swinging movement of the hanging members and foot platforms.

FIGS. 7*a* to 7*d* are cross-sectional views of pivot point 304 and hanging member 306 junctures. In FIG. 7*a*, a ball end 350 of hanging member 306 is received in socket 352 in pivot point 304. A force plate 354 is rotably connected to an end of threaded bold 358 that extends through and engages threaded opening 360. The other end of bolt 358 is affixed to turning knob 362. When turning knob 362 is turned in a clockwise direction, force plate 354 is forced against ball 350 to lock hanging member 306 at a desired position to regulate resistance and to limit swinging movement.

Figure 7B:
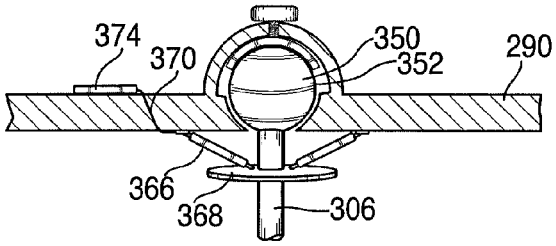

In a variation of the structure shown in FIG. 7*a*, as shown in FIG. 7*b*, the ball end 350 of hanging member 306 is received in a socket 352, and at least one hydraulic cylinder 366 extends from a support plate 368 on hanging member 306 to support member 290, to create means to regulate resistance and to limit swinging movement. Each hydraulic cylinder is pneumatically connected through a tube 370 to a control valve 374.

Figure 7C:
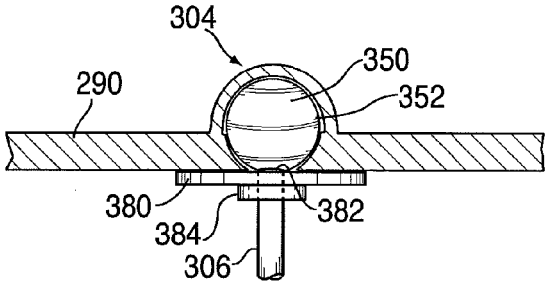
Figure 7E:
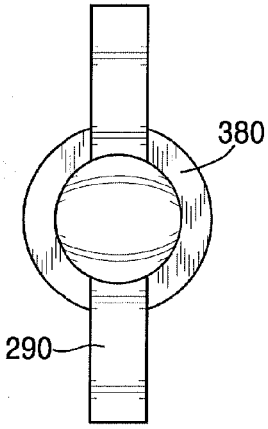
Figure 7D:
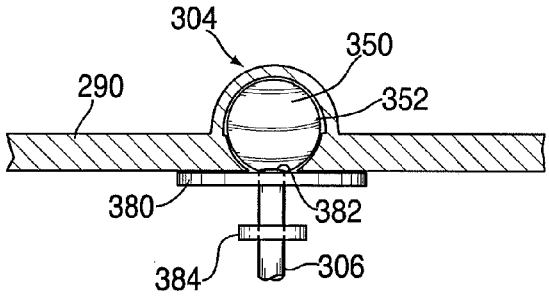
Figure 7F:
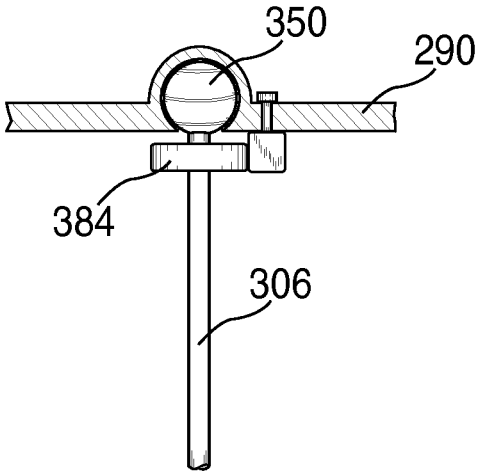
Figure 7G:
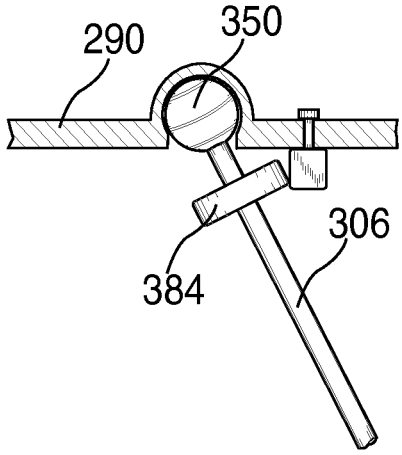
Figure 7H:
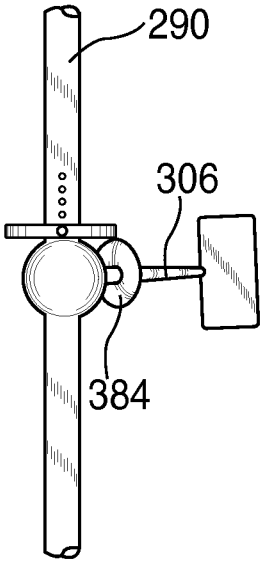
Figure 7I:
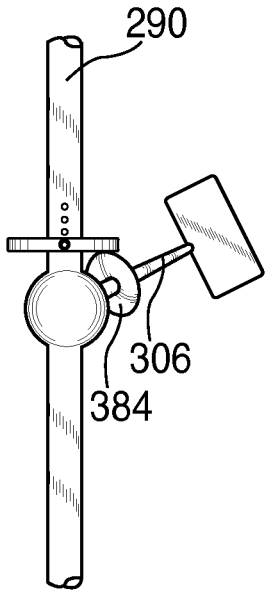

Another representation of a swing limiter aspect of the invention is shown in FIGS. 7*c* and 7*d*, where a support member 290 has a socket 352 that receives a ball 350 on the end of hanging member 306. A stop plate 380, preferably circular, with an opening 382 is positioned on the lower surface of support member 290 such that hanging member 306 extends therethrough. An adjustable height bumper 384 is positioned around hanging member 306, and stop member 384 is raised or lowered to adjust or limit the amount or degree of swing of hanging member 306. When stop member 384 is adjacent stop plate 380, as in FIG. 7*c*, there is essentially no swing. However, when height bumper 384 is lowered, as is FIG. 7*d*, there is more swing for hanging member 306 (and any foot platform attached thereto).

In the top view of FIG. 7*e*, stop plate 380 can be seen positioned below support member 290.

In the embodiment of the invention set forth in FIGS. 7*f* to 7*i*, the motion of a stop member 384 is limited by a stop block 386 that is positioned on support member 290 with a pop pin, screw, or other attachment mechanism 388. As stop block 386 is positioned away from ball 350, handing member 306 has more motion. Stop block 386 can be straight, curved, or otherwise configured to impart a desired limitation on the motion of hanging member 306.

Figure 8:
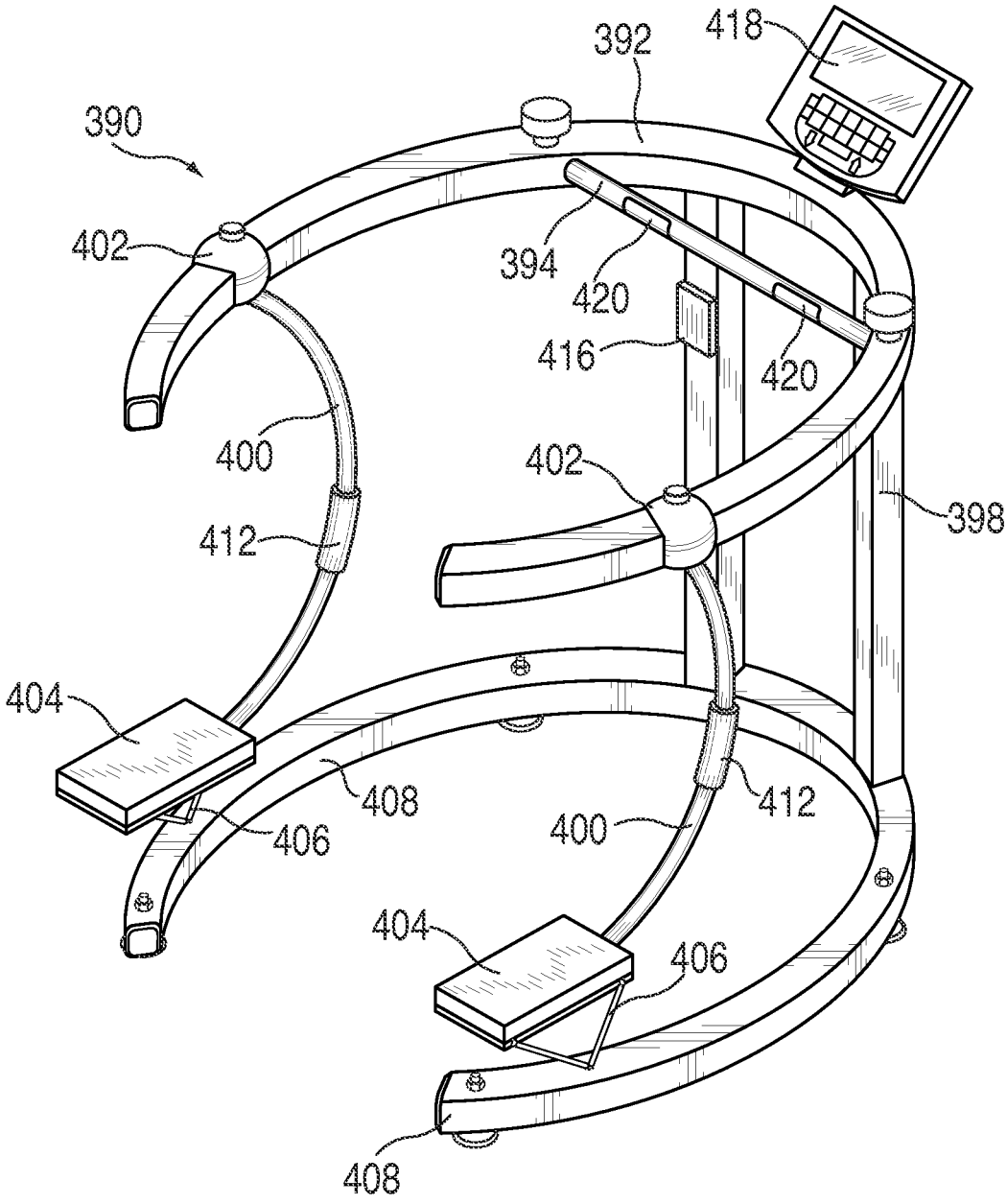
FIGS. 8, 9*a*, and 9*b* each depict another embodiment of an apparatus according to the invention.

FIG. 8 is a single arm embodiment of the invention where an exercise apparatus 390 comprises an upper support structure 392 with a handle bar or crossbar 394, attached to a stand 398. On each side of upper support structure 392 a hanging member 400 extends from a pivot point 402 to a foot platform 404. Each foot platform 404 is tethered by an elastic member 406 to a bottom portion 408 of stand 398, to create swing limiters. Hanging member 400 has a shock absorber or springing shaft 412 to provide a third degree of movement.

Apparatus 390 comprises various sensors and analyzers that sense and analyze data that can be inputted to a CPU 416 and then displayed on a monitor 418. Means to track and record the direction of swing, distance, speed, and acceleration can be housed in pivot points 402, and parameters such as heart rate, blood pressure, and/or pulse rate can be measured by sensors such as sensors 420 in crossbar 394. Data can be analyzed in CPU 416 to track, record, store, and/or display the data, to provide biofeedback, or to use the data in an interactive game or program. The CPU may have slots or other openings to receive flash drives, discs, plugs, CDs, or DVDs to receive or export data or programs.

Figure 9A:
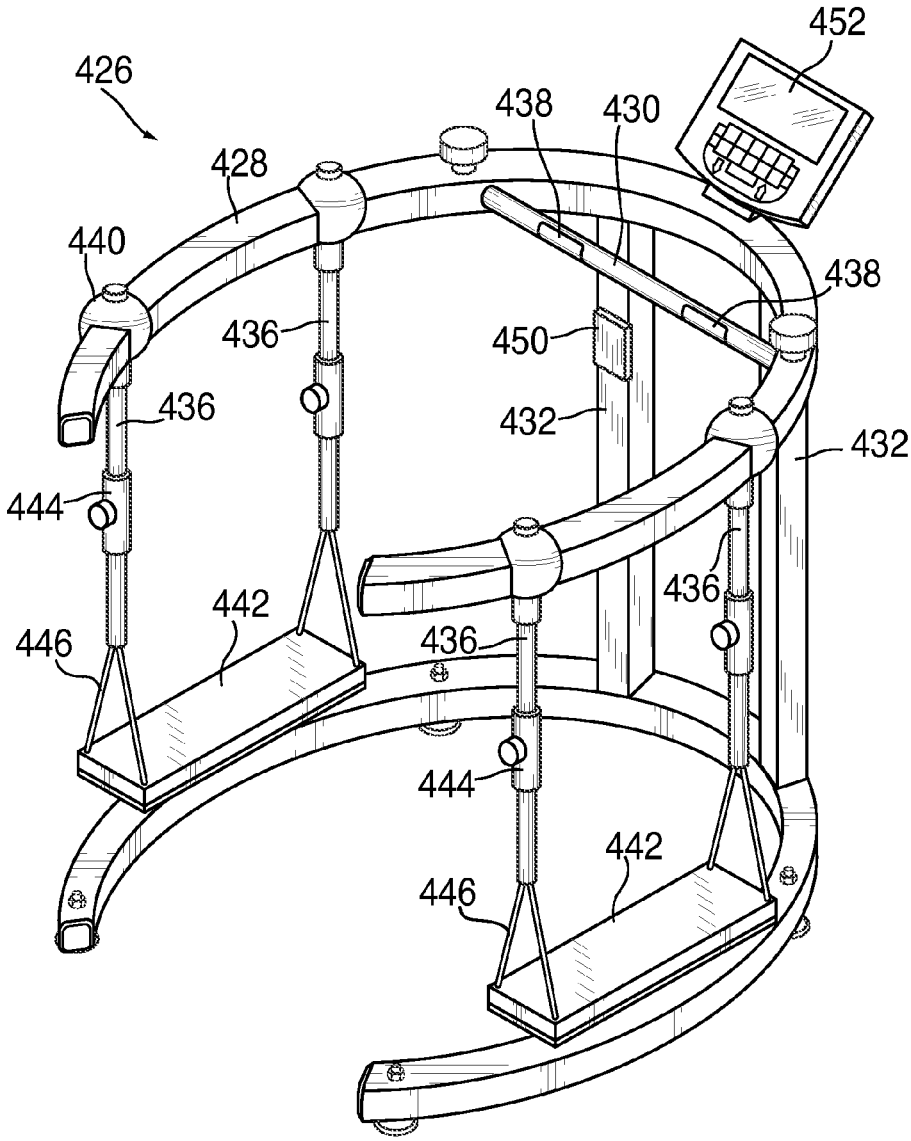
Figure 9B:
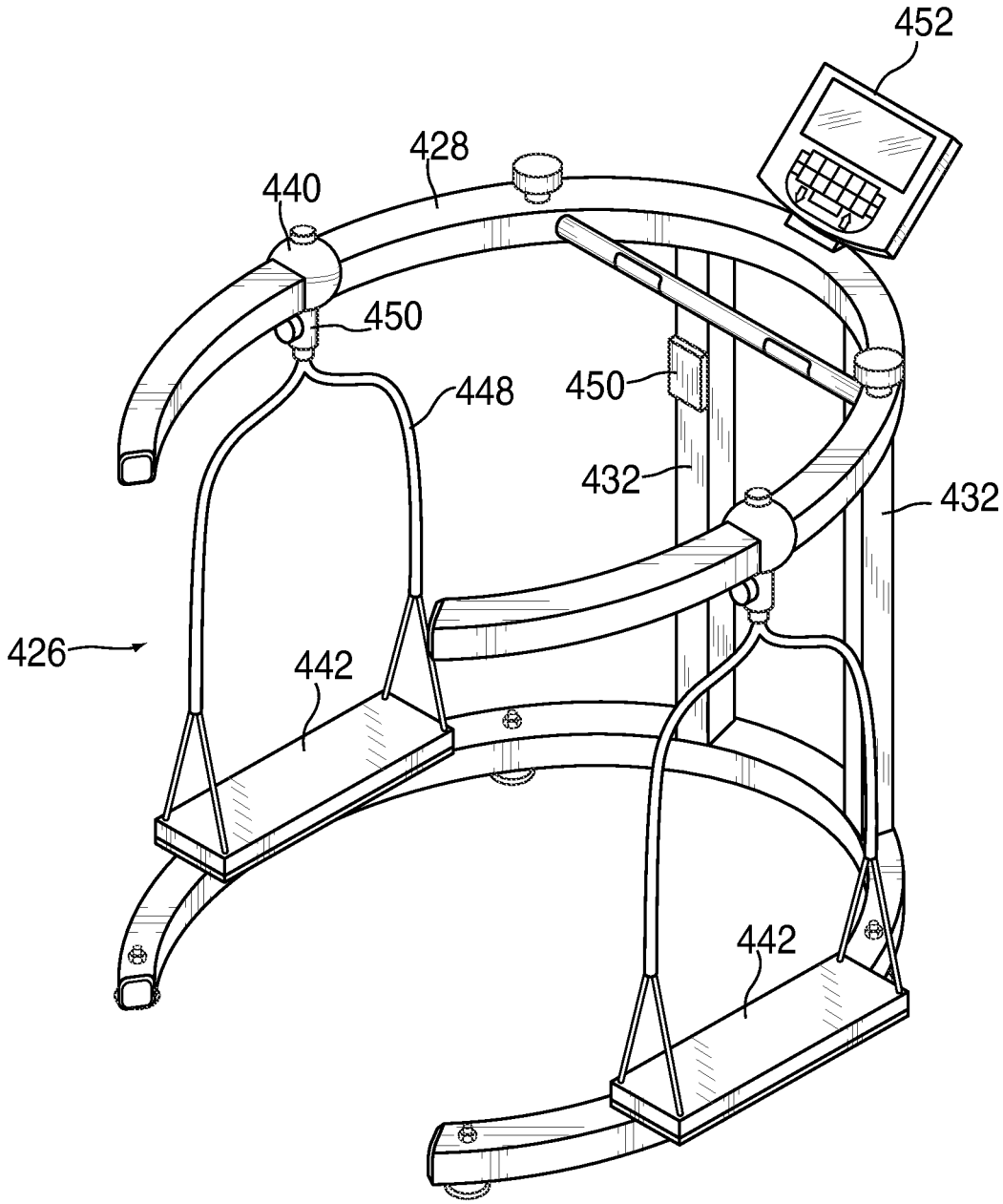

In the embodiment of the invention shown in FIGS. 9*a* and 9*b*, an exercise apparatus 426 comprises an upper support structure 428 with a handle bar or crossbar 430 attached to a stand 432. On each side of upper support structure 428 a vertical hanging member 436 extends from a pivot point 440 to a foot platform 442. Each hanging member 436 is a solid adjustable bar with a height adjustment mechanism 444 for lowering or raising the height of each foot platform 442. Each foot platform 442 is connected to a hanging member 440 by band, springs, or shock absorbers 446.

Apparatus 426 comprises various sensors and analyzers that sense and analyze data that can be inputted to a CPU 450 and then displayed on a monitor 452. Means to track and record the direction of swing, distance, speed, and acceleration can be housed in pivot points 440, and parameters such as heart rate, blood pressure, and/or pulse can be measured by sensors 438 in handle bar 430. Data can be analyzed in CPU 450 to track, record, store, analyze, and/or display the data, to provide biofeedback, or to use the data in an interactive game or program.

In another embodiment of the apparatus of the invention shown in FIG. 9*b*, each foot platform is suspended from a single pivot point 440 with a wishbone-shaped, two-arms hanging member 448. An adjustment member 450 positioned below the pivot point 440 can adjust the height of the wishbone structure.

Figure 10A:
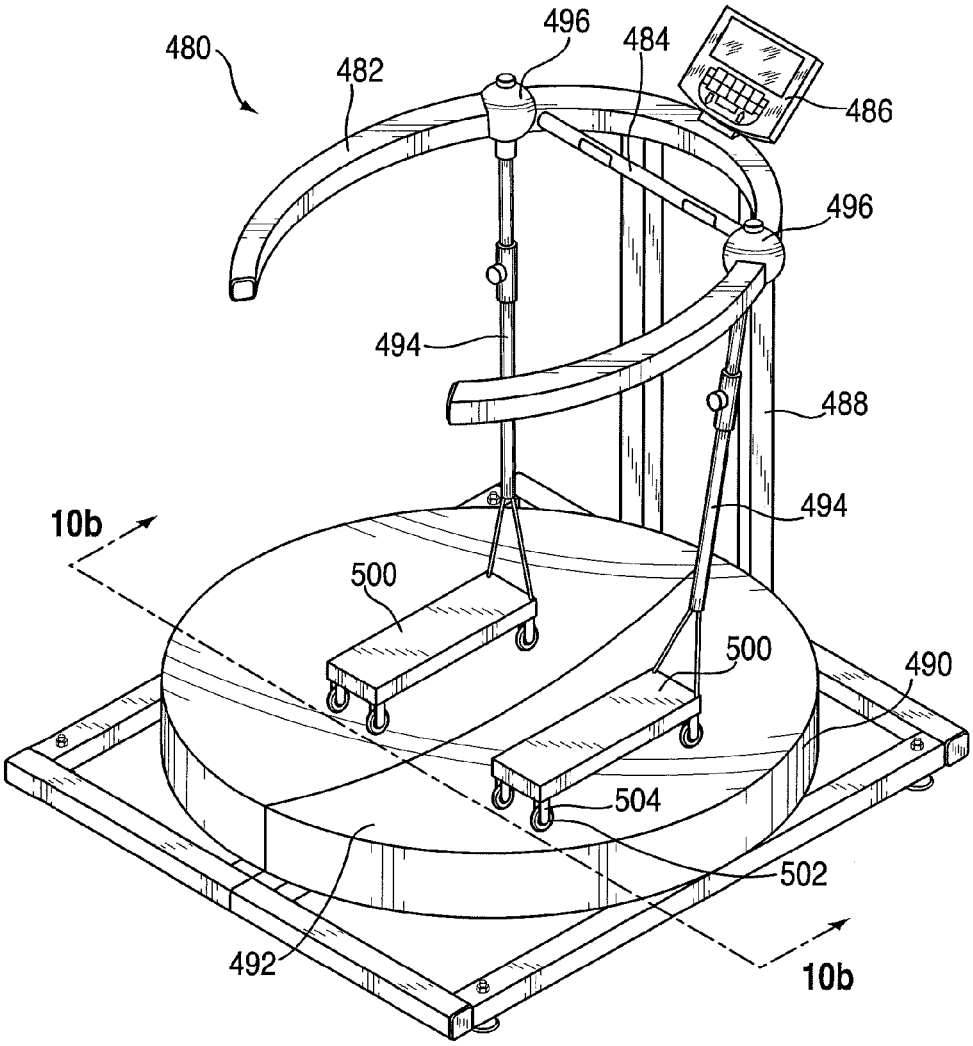
FIGS. 10*a* and 10*b*, depicts an embodiment of an exercise apparatus according to the invention where a base with contoured surfaces comprises a skate platform.
Figure 10B:
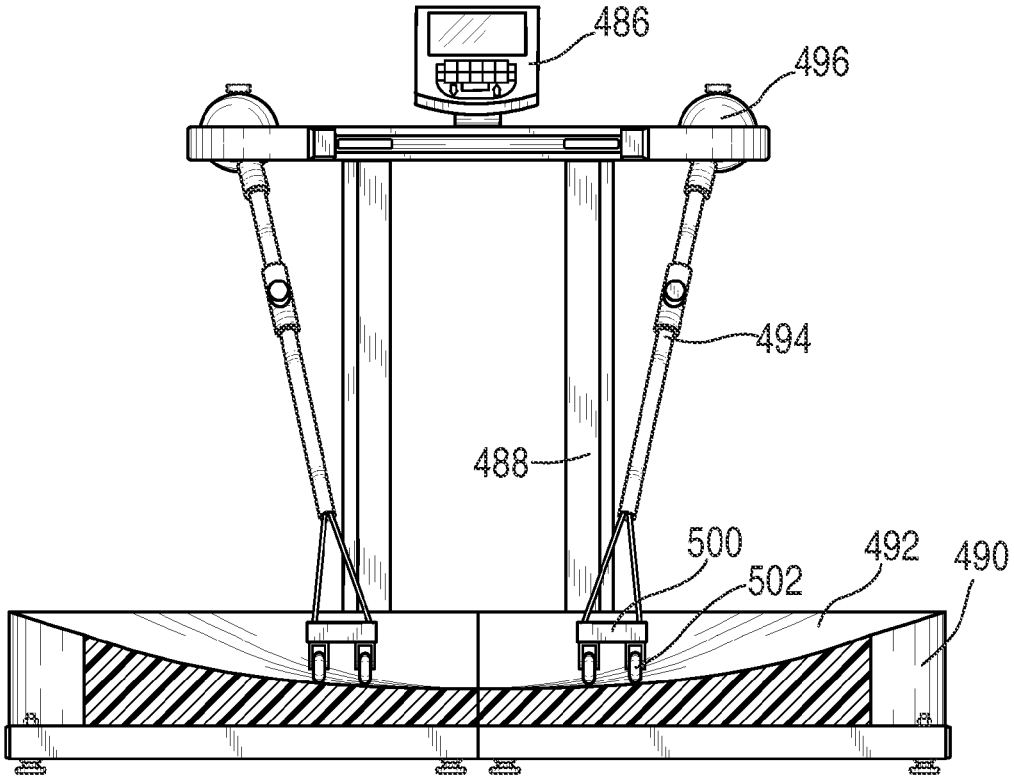

In the representation of an embodiment of the invention set forth in FIGS. 10*a* and 10*b*, an exercise apparatus 480 comprises an upper support member 482 with a crossbar 484 and a monitor and/or CPU 486, attached to a stand 488. Stand 488 extends to and is supported by a base 490 comprising contoured surfaces 492. A hanging member 494 extends from a pivot point 496 on each side of upper support member 482 to a "skating" foot platform 500. Each foot platform 500 has multi-directional wheels, rollers, or castors 502, preferably four. Each wheel, roller, or castor 502 is connected to a foot platform 500 by spring tension means 504.

Figure 11:
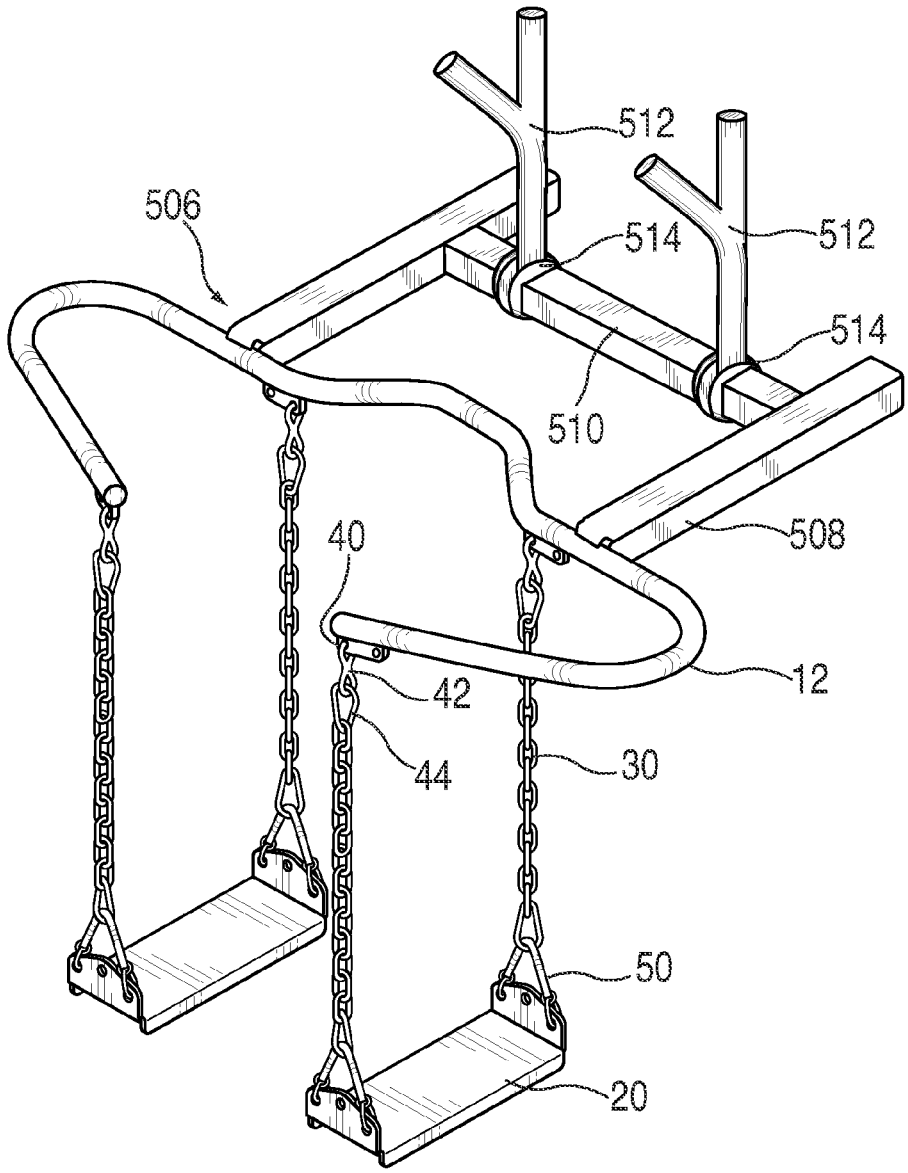
FIG. 11 depicts an embodiment of an exercise apparatus according to the invention where upper body exercisers are positioned on a crossbar.

In the embodiment of the invention shown in FIG. 11, an exercise apparatus 506 has support members 508 with a crossbar 510. Multi-position grip handles 512 positioned on crossbar 510 extend upwardly vertically from pivot points 514. Pivot points 514 provide tension to grip handles 512 to resist any forces exerted in the X-Y plane by a user. The resistance can be provided by the pivot points 514 themselves or by any of other known configurations, including, but not limited to, those shown in FIGS. 2*a* and 2*b*. Optimally crossbar 510 could also include an multidirectional arm unit such as unit 80 shown in FIGS. 2*a* and 2*b*.

Figure 12:
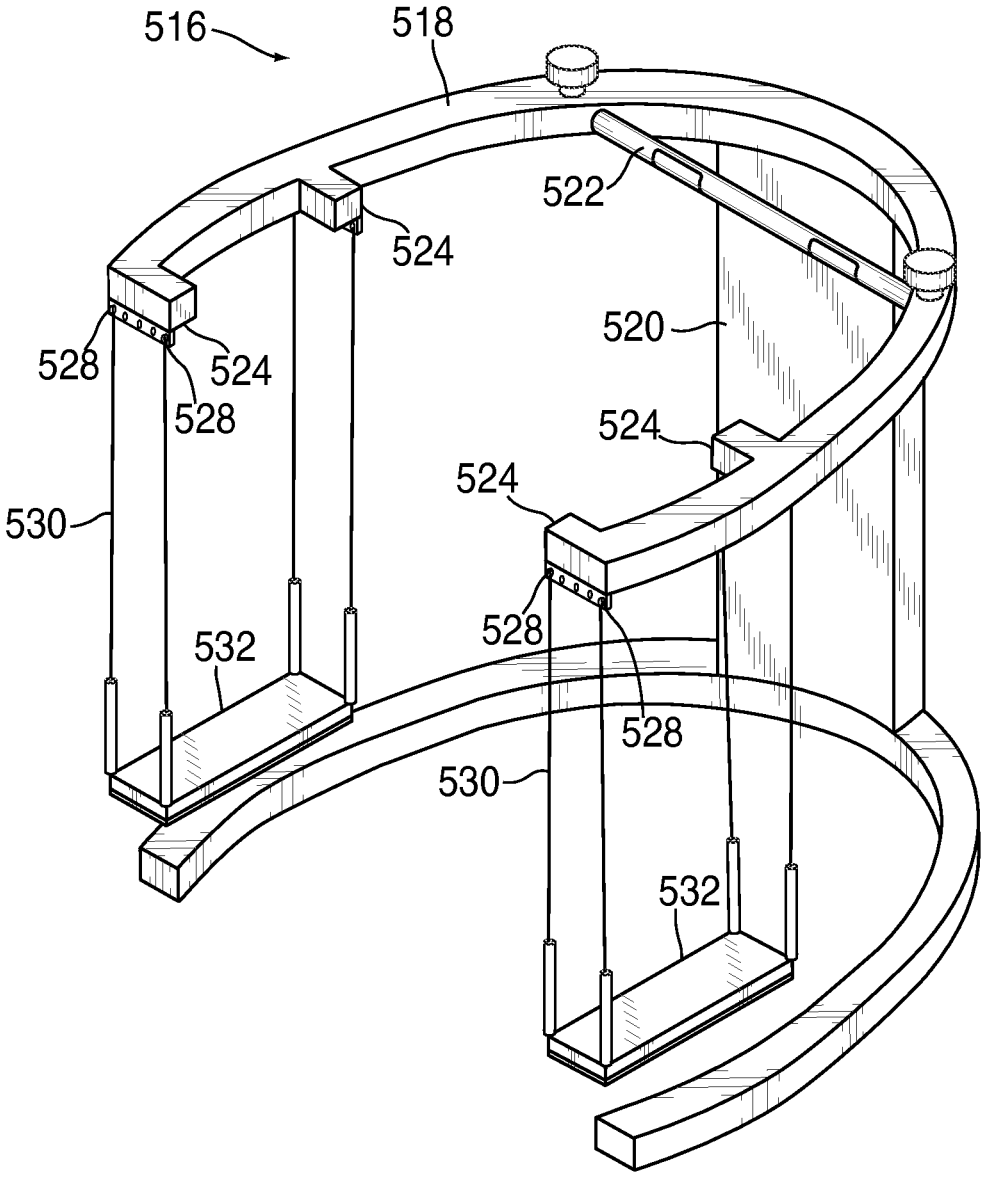
FIG. 12 depicts an embodiment of an exercise apparatus according to the invention with different support arms and hanging members.

In the exercise apparatus of the invention, the foot platforms can be supported in many different ways to allow for multi-directional swinging of foot platforms. FIG. 12 represents an embodiment of the invention where an exercise apparatus 516 comprises a support member 518 attached to and supported by a stand 520. Support member 518 has a crossbar 522 and inwardly extending support members 524. Here, each support member 524 has two connection points 528 from which a hanging member 530 extends to a platform 532. Each hanging member 532 can be rigid or flexible, elastic or non-elastic, optimally to provide spring or elastic tension to allow for "Z" direction of movement.

Various configurations have been described above to provide tension or resistance to movement of a portion of the exercise apparatus. In another embodiment of the invention shown in FIGS. 13*a* to 13*d*, an exercise apparatus 536 comprises a support member 538 supported by a stand 540. A rear portion 552 of support member 538 has two handgrips 546 extending from pivot points 548 and an exerciser 550 extending from pivot point 558. Foot platforms 554 are suspended by hanging members 556, which are each attached to a pivot point 560.

Figure 13A:
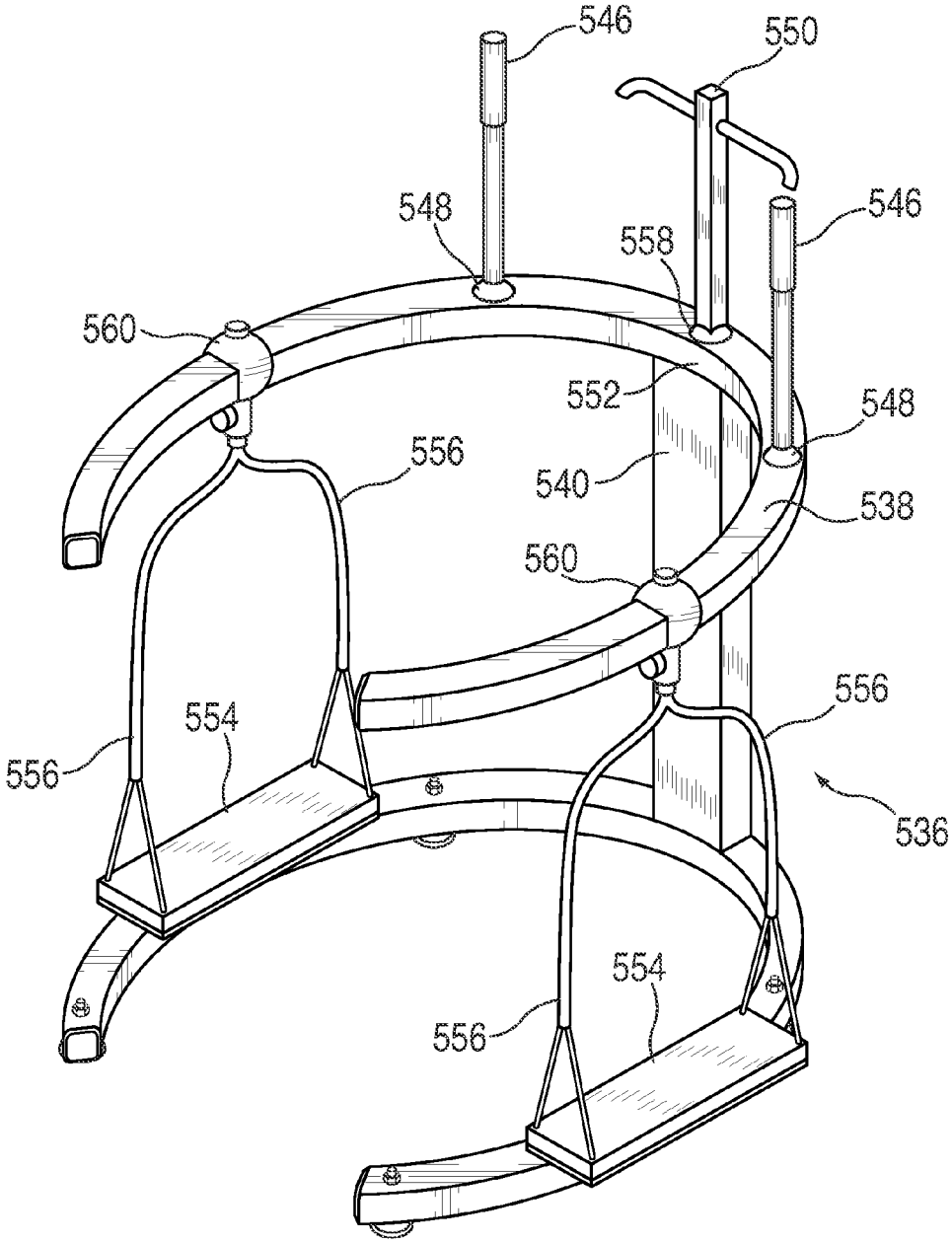
FIGS. 13*a* to 13*d*, depicts an embodiment of an exercise apparatus according to the invention with upper body systems where the resistance is regulated and the swinging movement is limited by servo motors and magnets.
Figure 13B:
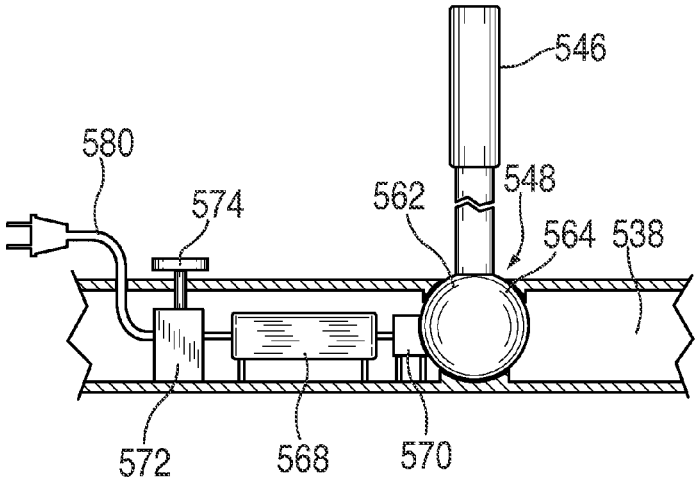

A hand grip 546 and pivot point 548 can be appreciated in the cross-section of FIG. 13*b*, a metal ball 562 of hand grip 546 is received in a socket 564 in support member 538. A servo motor or solenoid 568 is electrically connected to a magnet or eddy current unit 570 adjacent metal ball 562. Servo motor 568 is in communication with controller 572, which is in communication through wire 580 with a power source (not shown). A dial or switch 574 controls controller 572.

Figure 13C:
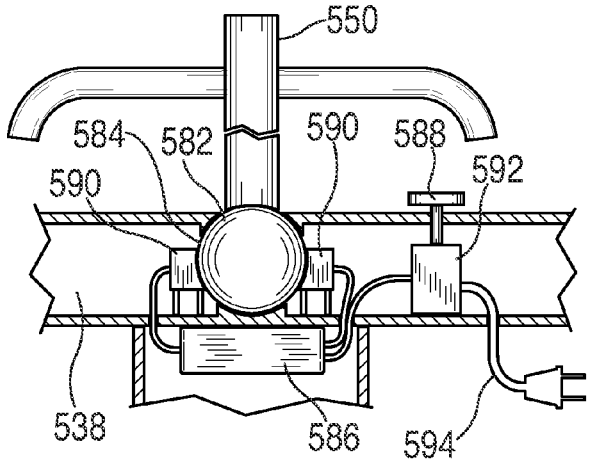

Similarly, as shown in FIG. 13*c*, a metal ball 582 forming part of exercise handle 550 extends into a socket 584 in support member 538 where a servo motor or solenoid 586 is electrically connected to magnets or eddy current units 590 at either side of metal ball 582. Servo motor 586 communicates with controller 592, which is in communication through wire 594 with a power source (not shown). A dial or switch 588 controls controller 592.

Figure 13D:
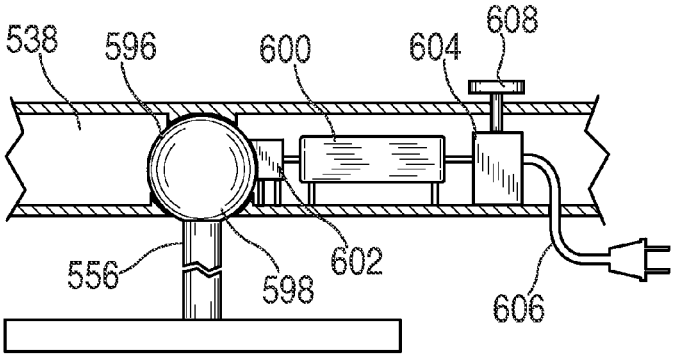

In FIG. 13*d*, the upper end of a hanging member 556 forms a ball 598 that is positioned within a socket 596 in support member 538. A servo motor or solenoid 600 is electrically connected to a magnet or eddy current unit 602 adjacent ball 598. Servo motor 600 is in communication with a controller 604, which in turn is in communication through wire 604 with a power source (not shown). A dial or switch 608 controls controller 604.

Another embodiment of the invention is set forth in FIG. 14, where an exercise apparatus 610, ladder hook-on assembly 618, and stand 622 are configured to accommodate users of different sizes or with special requirements. Various means are useful to adjust the distances between foot platforms and to increase or decrease forces on a user's lower body or change the angles of plates.

Adjustable exercise apparatus 610 comprises a C-shaped holding bar 612 and support bars 616. Holding bar 612 is attached to support bars 616, which are in turn attached to sleeve members 618. Sleeve members 618 are fittingly connected to stand 622, which comprises two cross-members 620.

Each cross-member 620 is configured to be adjustable in its length so that the distance between support bars 616 can be adjusted. Each cross-member preferably comprises two sections where one section slides within the other but the relative positions can be fixed by pop pins or similar means. Optimally hydraulic means could be used to slide the sections of cross-members 620 back and forth.

While, in one embodiment, support bars 616 can be attached to sleeves 618, in another embodiment the relative position of a support bar 616 to a sleeve 618 can be adjusted. As shown in FIG. 14, a support plate 628 with holes 630 will allow support bar 616 to be rotated about sleeve 618. Pop pins 634 or other means will hold support bar 616 in position. This could be done hydraulically as well. To allow support bars 616 to rotate in this fashion, C-shaped holding bar 612 will have a section 632 that splits or uncouples. For example, optionally opposite sections of holding bar 612 are configured at section 632 to slide along a circular member (not shown) within section 632 or over one another in a male/female arrangement.

Support bars 616 attach to holding bar 612 at junction points 636. It is within the scope of the invention that each junction point 636 is configured to permit a portion of holding bar 612 to move back and forth in a direction perpendicular to support bar 616. The junction point could comprise slidable sleeves that can be fixed together with, for example, pop pins, or a hydraulic cylinder.

The embodiments of the invention described above mostly comprise a support member from which hanging elements support flat platforms. These configurations are especially appropriate to certain users and exercises, especially those where support for the user at the hip level is important. There are also embodiments of the invention where foot platforms are supported in a different manner. In the embodiment of the invention shown in FIG. 15, an exercise apparatus 650 comprises a handlebar member 652 which is connected through stand 654 to a base 656. Base 656 comprises longitudinal support members 658 that support foot platforms 662. Each foot platform 662 has a support system comprising slidable or rollable cross-pieces 666 so that foot platforms 662 can independently move, forward, back, or side-to-side. Base 656 may have adjustable supports 668 that raise or lower portions or corners of base 656.

Figure 15:
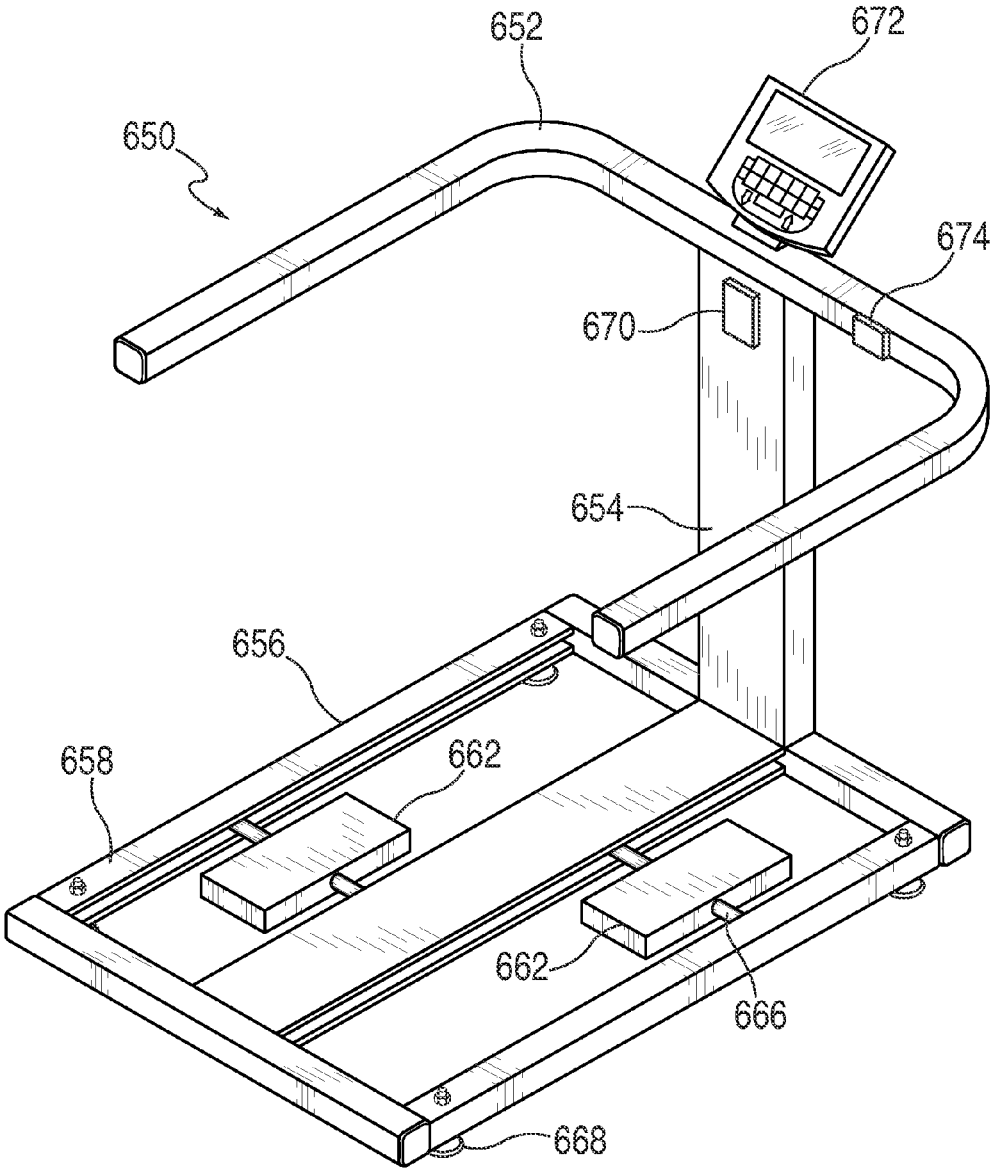
FIGS. 15 to 20 depicts other embodiments of an exercise apparatus according to the invention where foot platforms are supported by a base.

The embodiment FIG. 15 may include means to track, record, etc., the position of each foot platform 662 in three dimensions. Data is communicated to CPU 670, which displays data on display screens 672. A controller 674 is in communication with various sensors (not shown).

Figure 16:
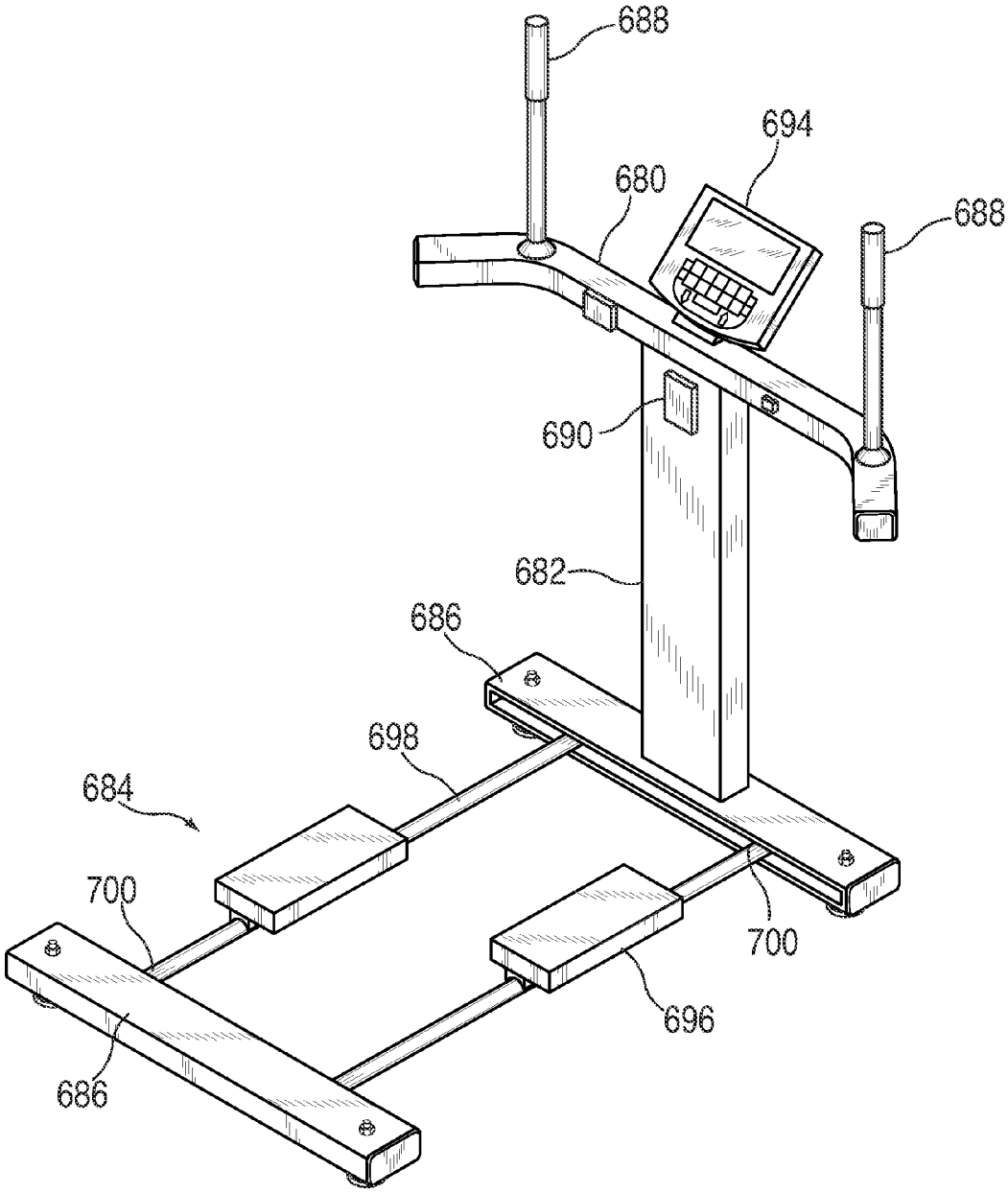

In the embodiment of the invention shown in FIG. 16, a handlebar 680 is attached to a stand 682 supported by a base 684 comprising two parallel laterally extending members 686. Handlebar 680 comprises upper body systems 688, a CPU 690, and display screen 694. Foot platforms 696 are supported by support members 698, the ends 700 of which are supported by lateral members 686. Support member ends move slidably within or atop lateral members 686 so that the user can move back and forth. In addition, foot platforms 696 move longitudinally along support members 698, so that the user can move his or her feet in the X-Y direction.

Figure 17:
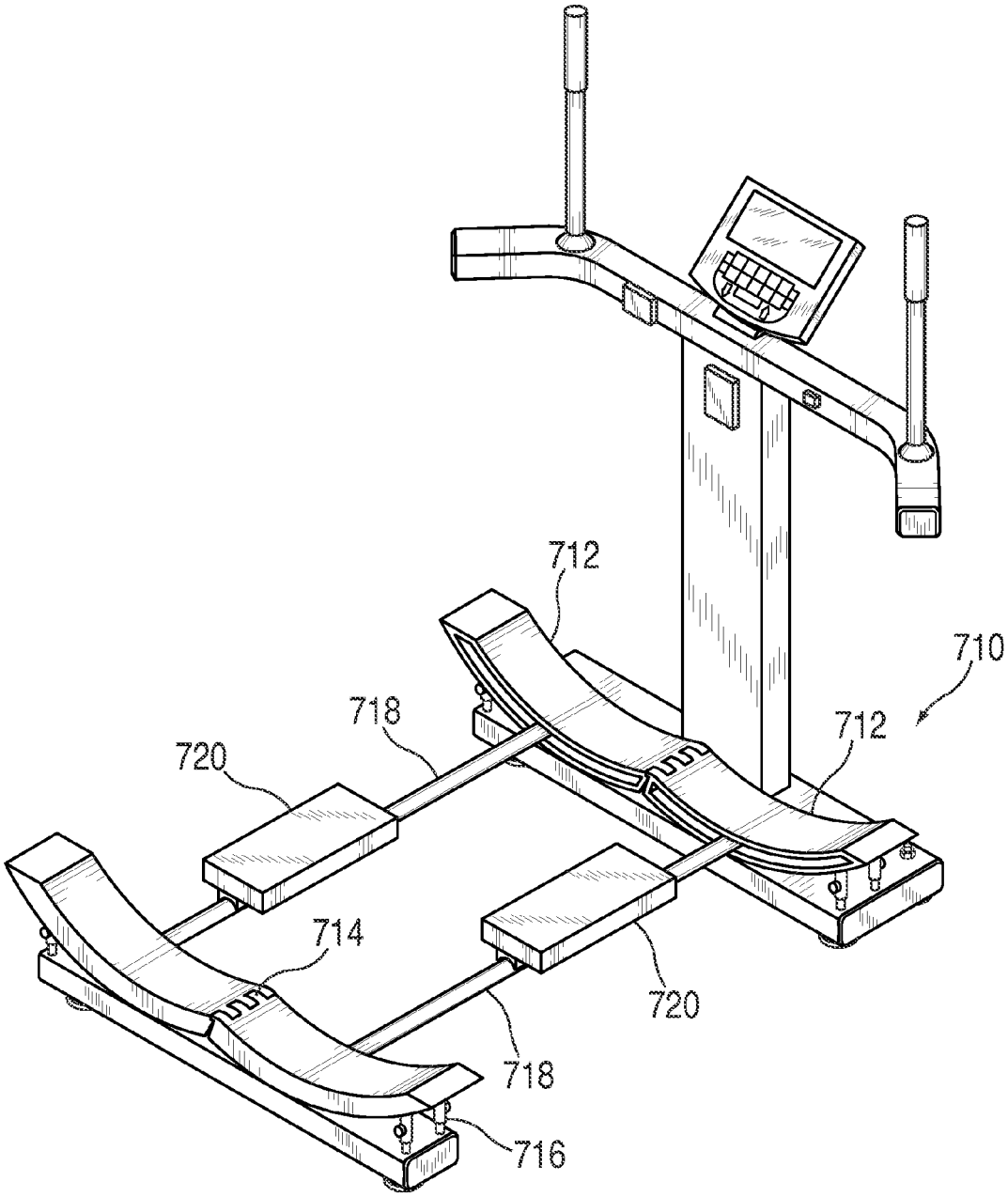

A variation of the embodiment of FIG. 16 is shown in FIG. 17, where lateral support members 710 comprise sections 712 hinged at hinge 714, that may be curved or straight. Also, each outside end of a section 712 has a servo mechanism 716 that can raise or lower that outside end. Longitudinal support members 718 are movably supported by sections 712 in turn support foot platforms 718, so that foot platforms 720 can move in three dimensions.

Figure 18:
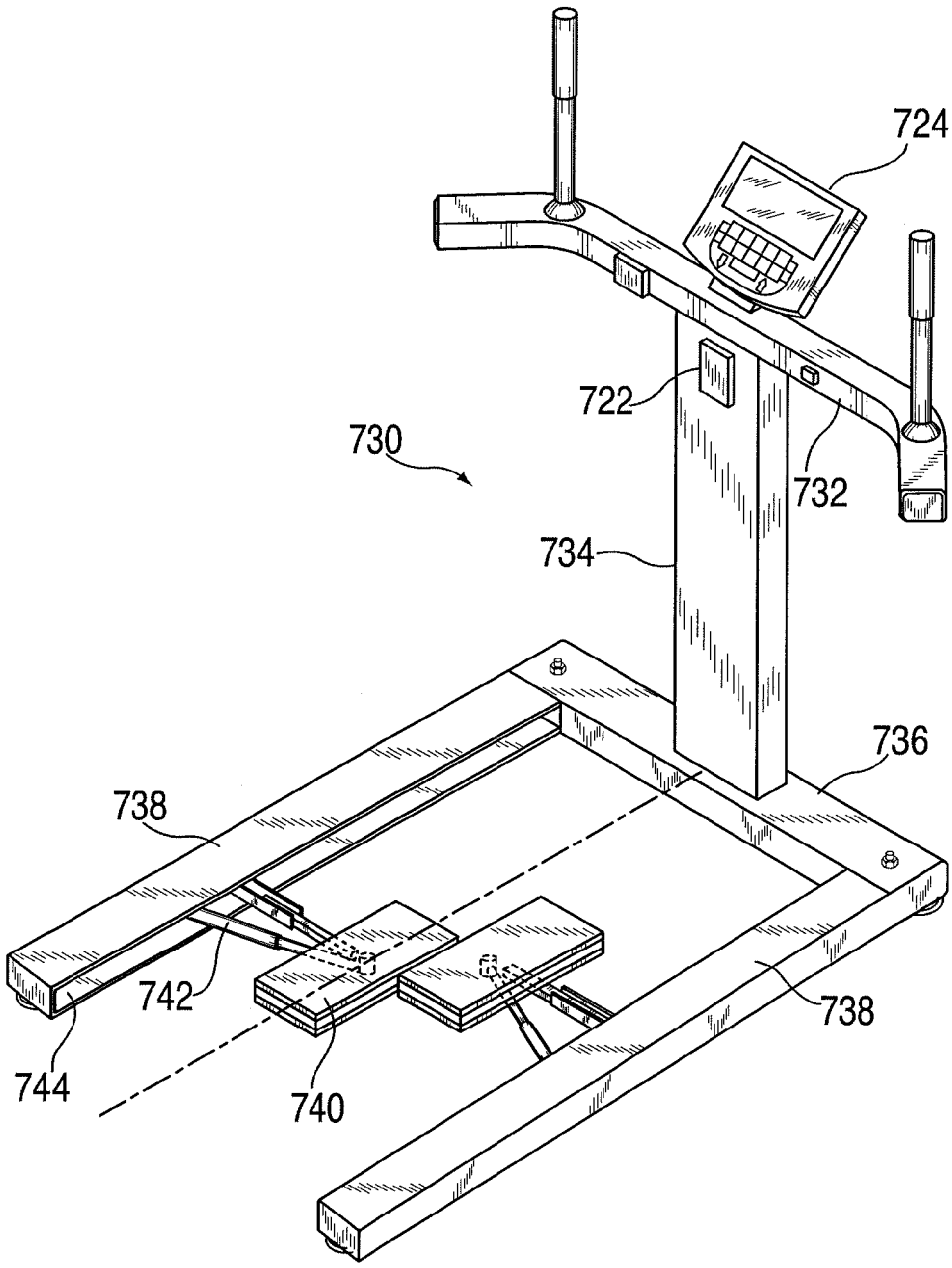
Figure 20:
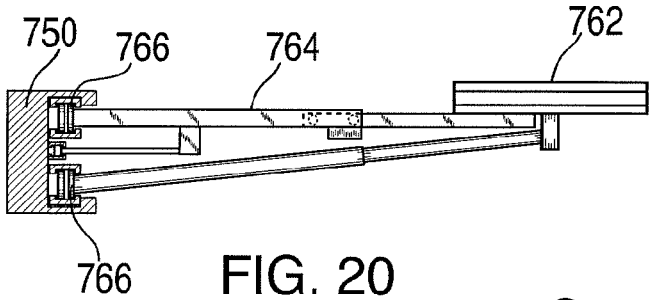
Figure 19:
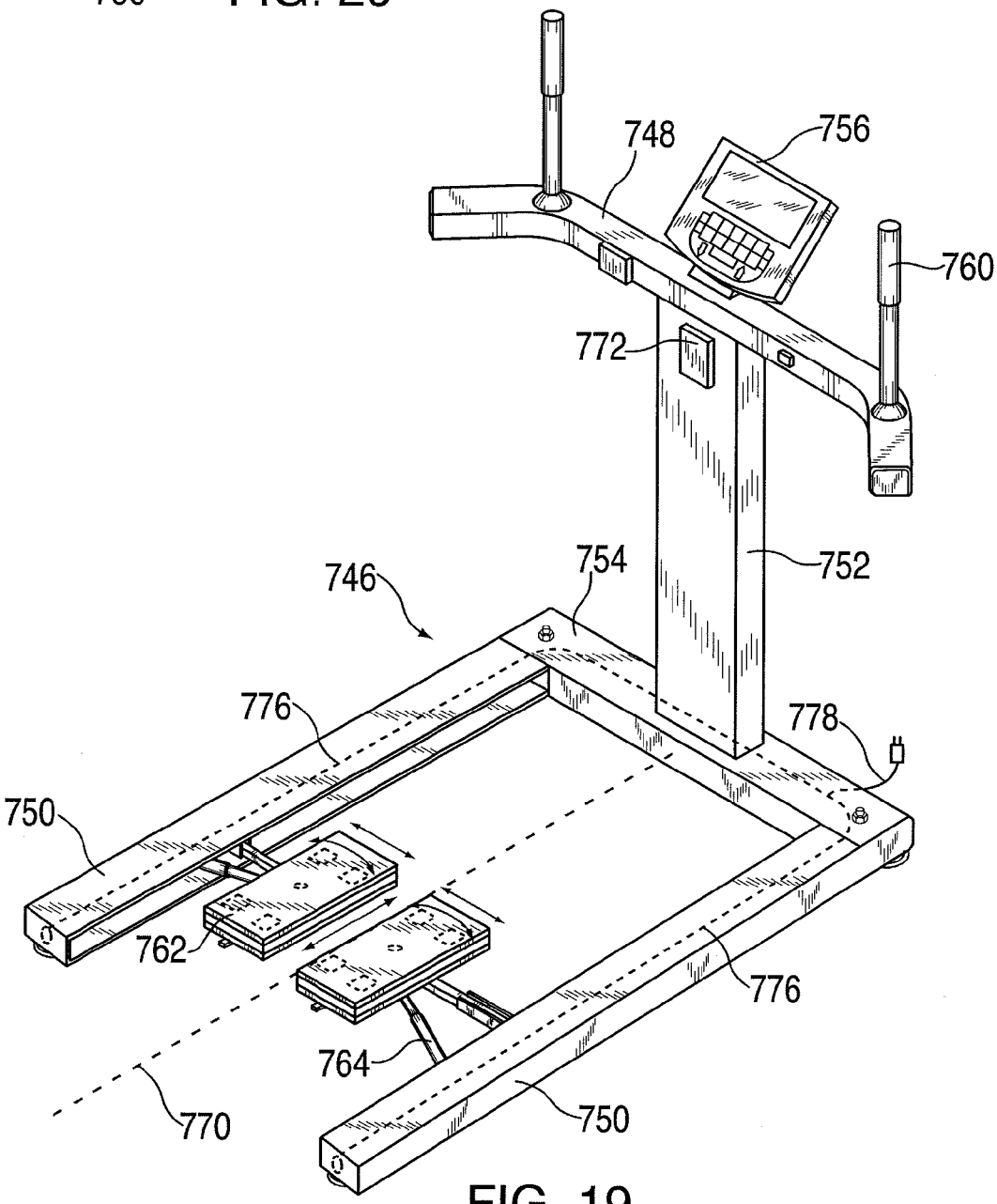

The embodiments of the invention set forth in FIGS. 18 to 20 are directed to exercise apparatuses wherein the foot platforms are supported in different manners. The exercise apparatus 730 in FIG. 18 has a handle bar 732 attached to a support 734, which in turn is attached to a base 736. A CPU 722 on support 734 is in communication with a display 724. Base 736 comprises two longitudinally extending members 738 to which foot platforms 740 are attached through support members 742. Support members 742 are positioned to be perpendicular to a longitudinally extending member 738 and to be slidable in a track 744 atop or in a lateral surface of longitudinally extending member 738. Also, foot platform 740 is slidable or movable along support member 742, with the result that each foot platform 740 has two degrees of movement.

In the embodiment shown in FIG. 19, an exercise apparatus 746 has a handlebar 748 supported by vertical member 752, which is attached to base 754 with longitudinally extending members 750. Handlebar 748 has a display 756 and hand grips 760 attached thereto. Foot platforms 762 are supported by supports 764 so that each foot platform 762 can move backwards and forwards as well as up and down, in three degrees of freedom. There are roller slides 766, shown in FIG. 20, so that the foot platforms 762 can move along supports 764 as well as across center line 770.

Optionally exercise apparatus 746 has a CPU 772, sensors to measure movement and pressure to provide biofeedback data, and signals through wires 776. Power is supplied through a power cord 778 from a power source (not shown). In the embodiment shown in FIG. 19, an exercise apparatus 746 has a handlebar 748 supported by vertical member 752, which is attached to base 754. Handlebar 748 has a display 756 and hand grips 760 attached thereto. Foot platforms 762 are supported by support 764 so that each foot platform 762 can move backwards and forwards as well as up and down, in three degrees of freedom. There are roller slides 766 so that the foot platforms 762 can move along supports 764 as well as across center line 770.

In the invention herein, many different types of foot platforms are useful, especially foot platforms that can slide along a track. Typically, the foot platforms have a top plate, optionally atop a base plate, with wheels adopted to follow a defined pathway. The foot platforms are slidable in as frictionless a manner as possible.

Figure 21A:
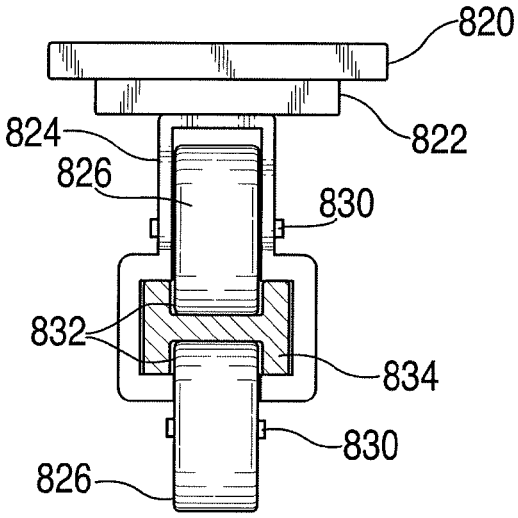
FIG. 21 depicts a representation of a foot platform according to the invention that is useful in embodiments such as those shown in FIGS. 15 to 20.
Figure 21B:
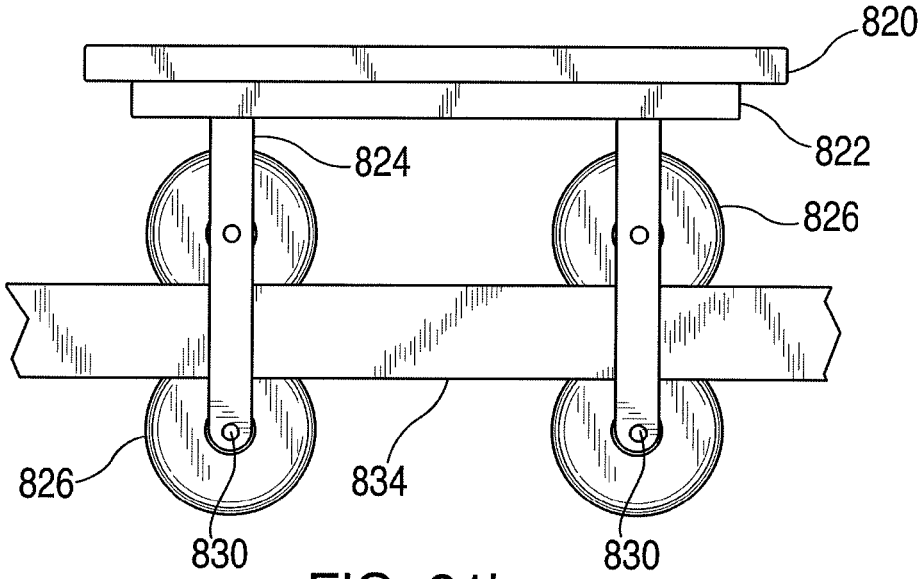

A representative example of a foot platform is shown in the partially cross-sectional views of FIGS. 21*a* and 21*b*. A top plate 820 is supported by a base plate 822, which has a wheel support frame structure 824 that holds wheels 826 on bolts 830. Wheel support frame structure 824 holds wheels 826 in the grooves 832 in an I-beam rail 834.

Figure 22A:
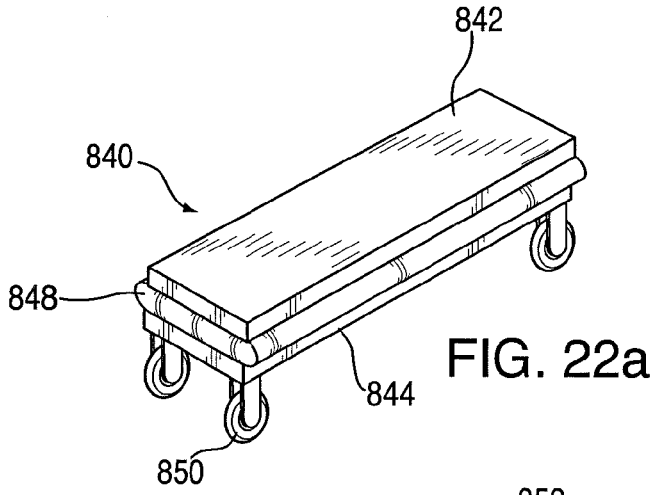
FIGS. 22-27 depict other embodiments of the invention.
Figure 22B:
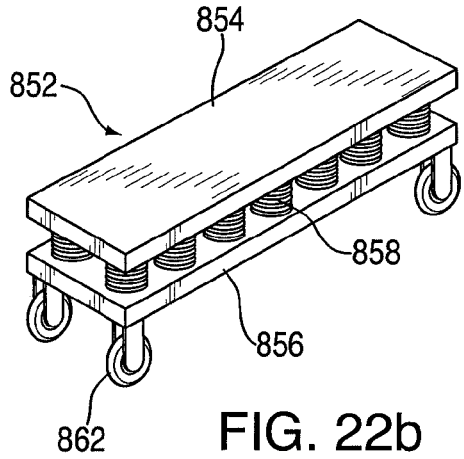
Figure 22C:
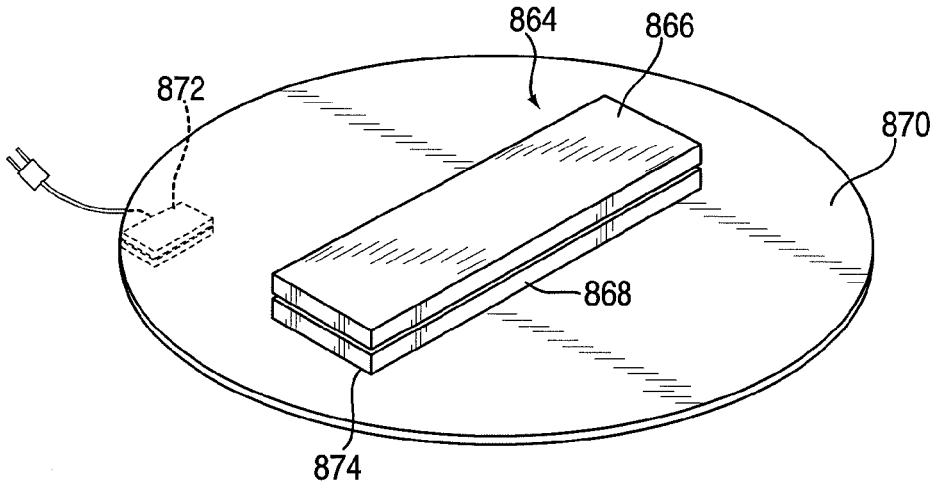

Other embodiments of foot platforms useful according to the invention are shown in FIGS. 22*a* to 22*c*, which foot plates can provide an extra degree of freedom to a user's foot. A footplate 840 in FIG. 22*a* comprises a top plate 842, a base plate 844, and an inner air cushion 848 positioned between top plate 842 and base plate 844. Optionally, footplate 840 has multi-directional wheels, rollers, or casters 850. In FIG. 22*b*, a foot platform 852 comprises a top plate 854, a base plate 856, and spring means 858 positioned between top plate 854 and base plate 856. Foot platform 852 has multi-directional wheels, rollers, or casters 862.

The foot platform 864 in FIG. 22*c* comprises a top plate 866 and a magnetic base plate 868, which plates are bonded, screwed, or glued together, and foot platform 864 is positioned above charged surface 870. The distance between magnetic base plate 868 and charged surface 870 results from maintaining opposite charges on the lower surface 874 of magnetic base plate 868 and charged surface 870 to cause lower surface 874 and charged surface 870 to repelled and maintain space therebetween. The magnetic forces can be regulated by a controller 872 that is connected to a power source (not shown).

Figure 23:
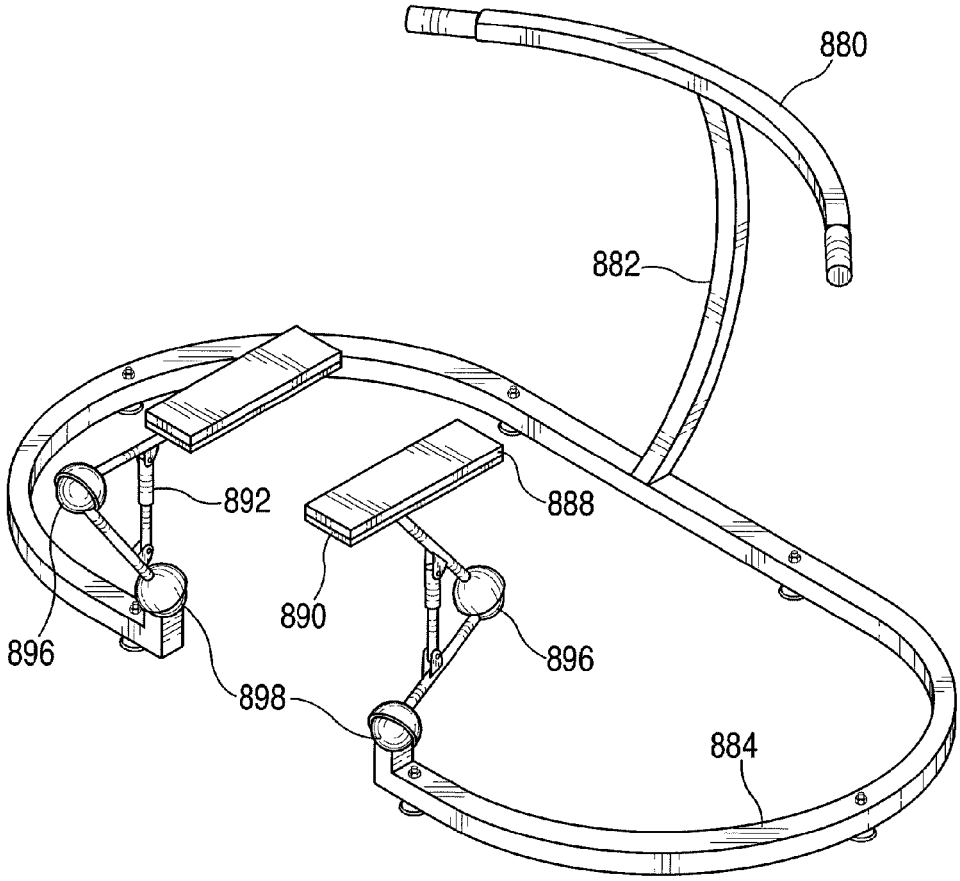

FIG. 23 is a representation of an exercise apparatus of the invention that simulates an ice skating motion. Handle bars 880 are connected through a support 882 to a frame or base 884, which base 884 is in a semi-circular, C-shape, or U-shape shape. A foot platform 888 is supported by, and slides on, a base 890 that is attached to a spring system and/or shock absorber system 892. System 892 has one or more pivot points 896 and 898.

Figure 24A:
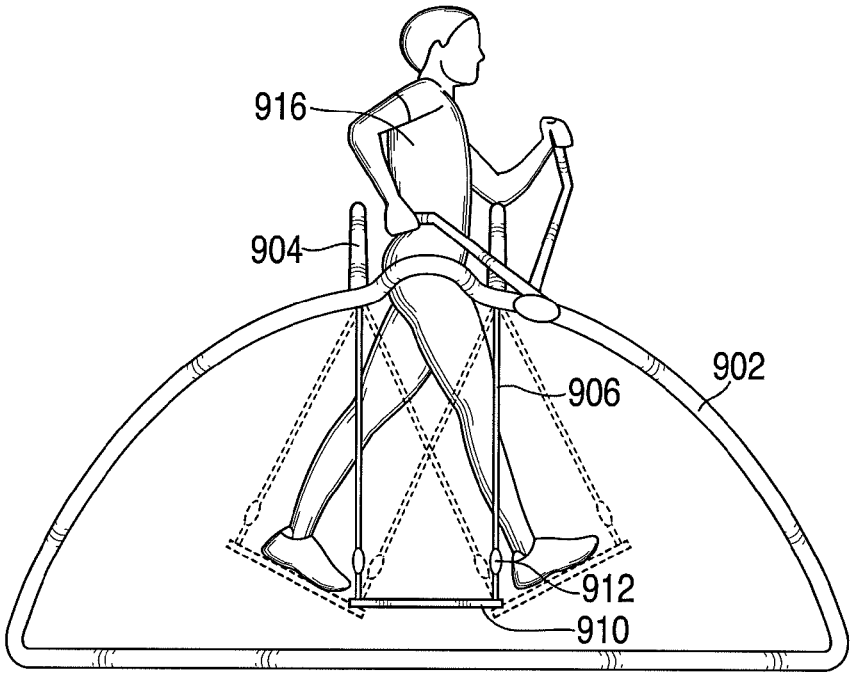
Figure 24B:
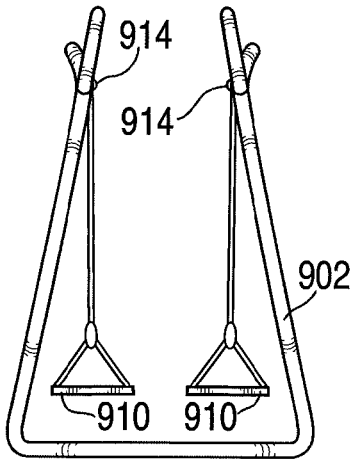

In the embodiment of the invention set forth in FIGS. 24*a* and 24*b*, a support 902 comprises pivot points 904 from which hanging members 906 are suspended. Foot platforms 910 are connected to the lower sections 912 of hanging members 906. Pivot points 904 comprise appropriate adjustable means, such as pop pins 914 so that a user 916 can adjust the height of the hanging members 906 and foot platforms 910.

Figure 25A:
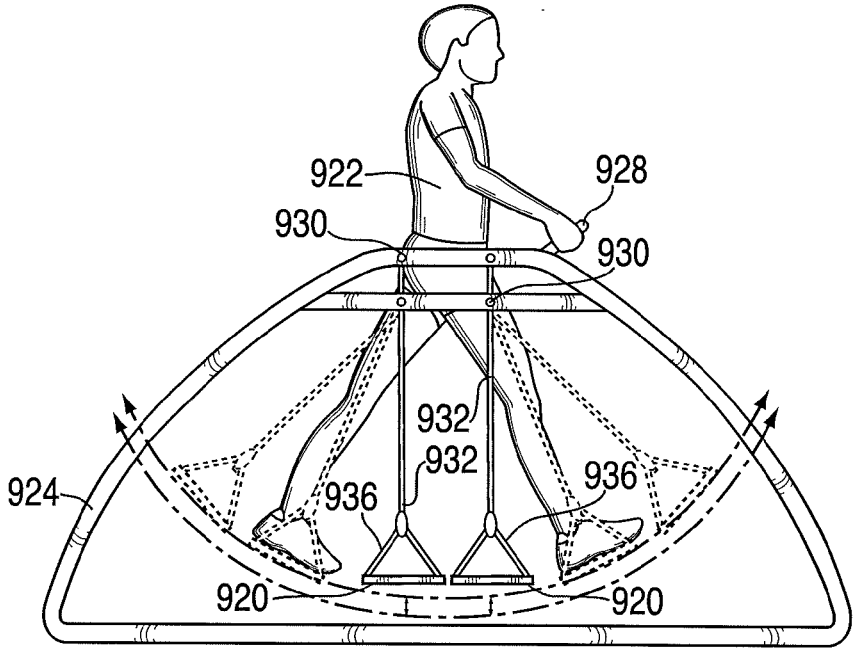
Figure 25B:
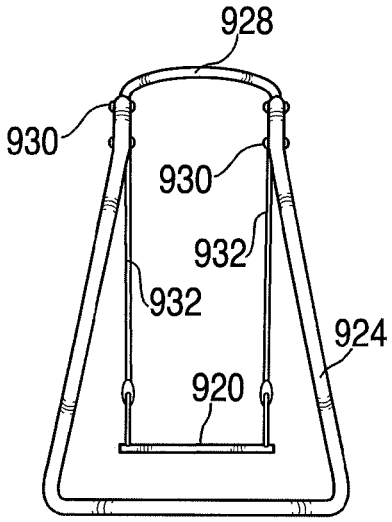

FIGS. 25*a* and 25*b* represent another apparatus of the invention where the foot platforms 920 are positioned to provide a different type of workout to a user 922. A support frame 924 comprises a handle 928 and means 930 for adjustably holding hanging elements 932. Foot platforms 920 are attached to hanging elements 932, which could be chains or straps attached to elastic bands 936. The user 922 is positioned on the apparatus so that the user's legs and feet go in the same, opposite, or multiple directions.

Figure 26A:
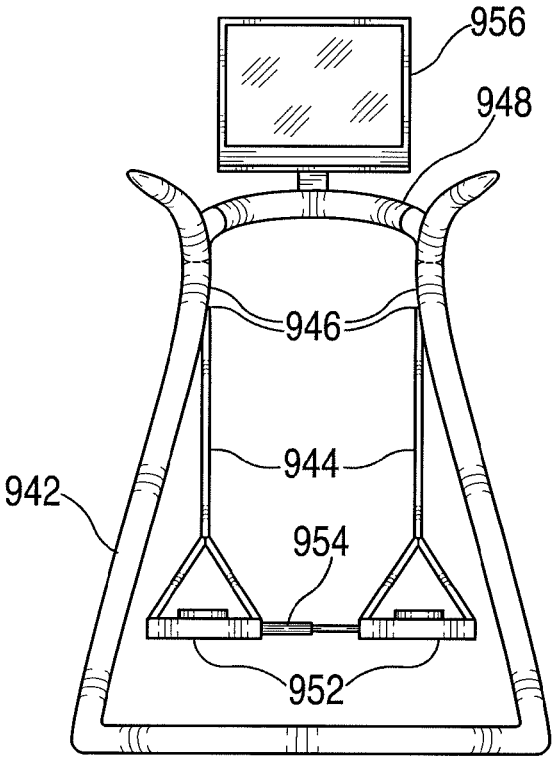
Figure 26B:
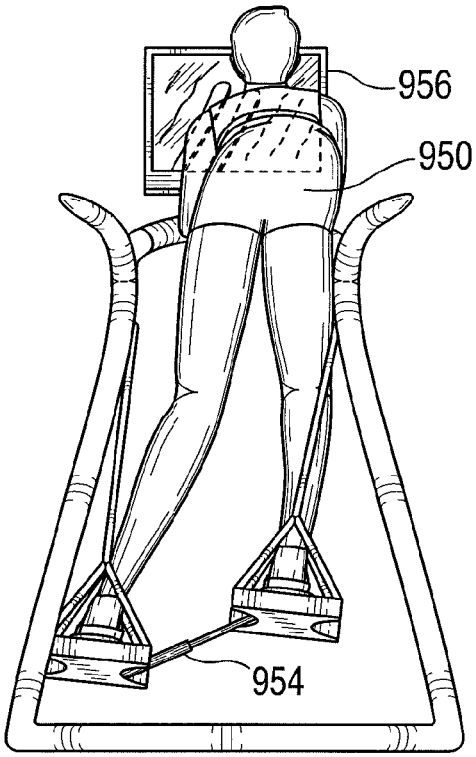
Figure 26C:
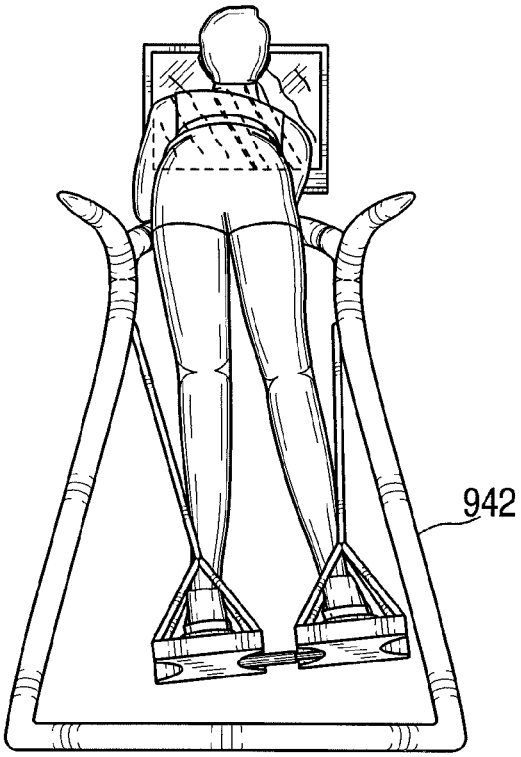
Figure 26D:
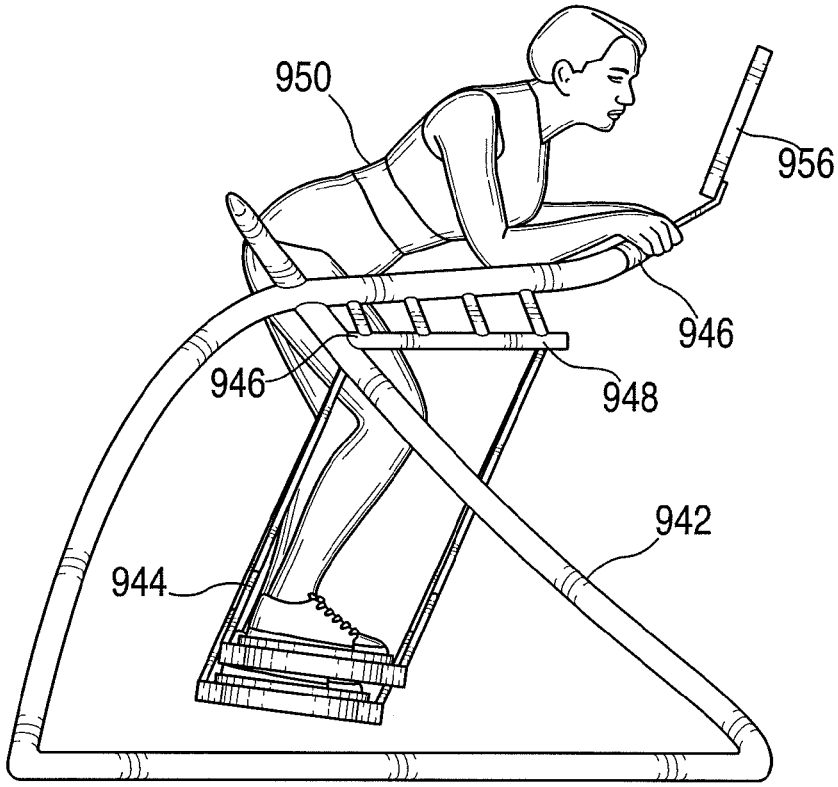
Figure 26E:
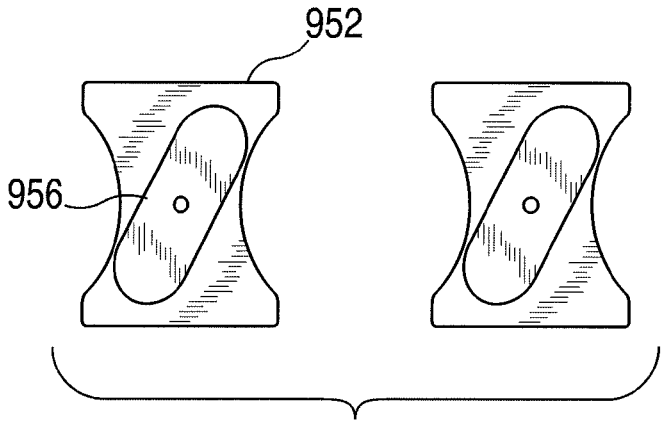

A dynamic downhill ski simulator is set forth in FIGS. 26*a* to 26*d*. A support frame 942 is configured so that hanging elements 944 are suspended from pivot points 946. A handlebar 948 is leveraged out so that as user 950 leans forward, foot platforms 952 tend to tilt forward. A connector member 954, which can be elastic or non-elastic, such as a rod or hydraulic member, connects foot platforms 952. Optionally, the user 950 can visualize performance a monitor 956 that displays data collected by sensors and analyzed by a CPU (not shown). Optionally, foot platforms 952 have pivoting members 956 for holding the feet of user 950, as shown in FIG. 26*e*.

Figure 27A:
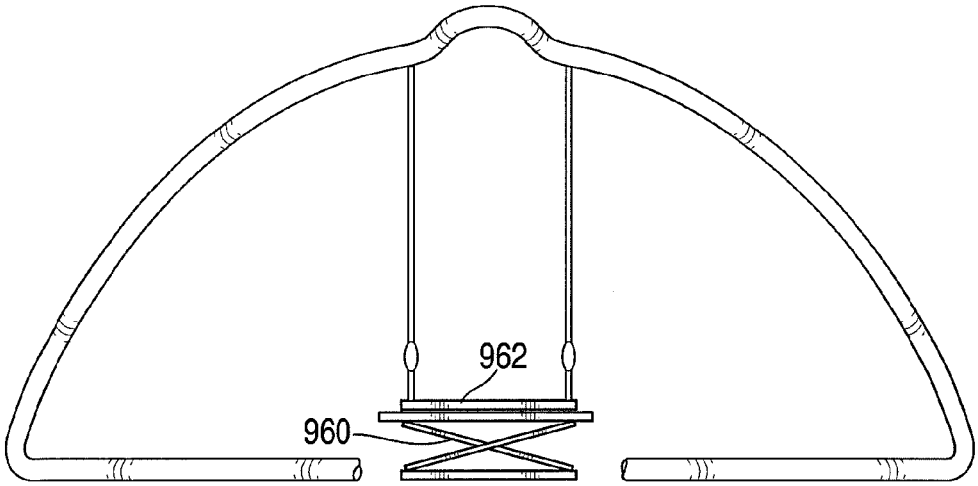
Figure 27B:
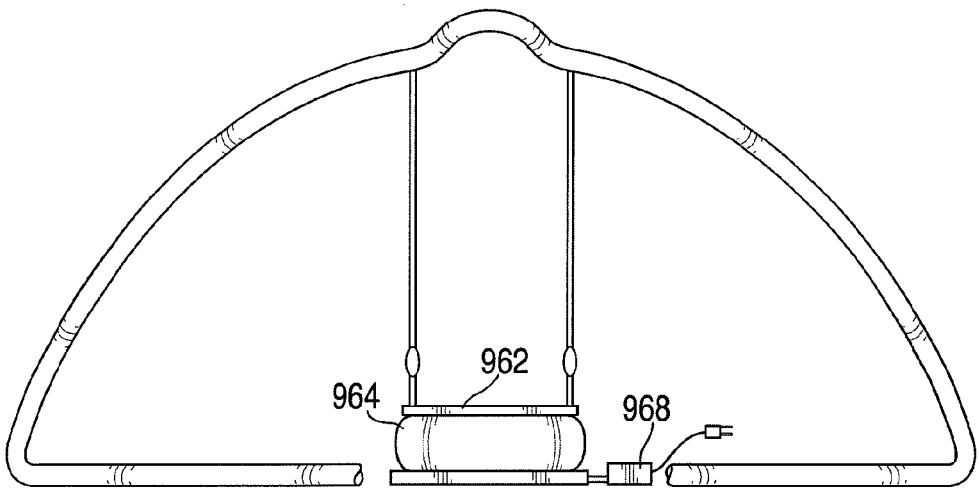

In another embodiment of the invention, where there are foot platforms that swing freely, a device can temporarily support or stabilize a user prior to or after use. In FIG. 27*a*, a scissor jack platform 960 is positioned beneath a foot platform 962. The platform 960 can be raised or lowered by mechanical means, such as a lever, or an electrical motor (not shown).

Alternatively, an air bag 964 could be inflated to stabilize a foot platform 962. Air bag 964 would be connected to a pump 968 having a controller (not shown) and connected to a power source (not shown).

While certain embodiments of the present invention have been illustrated and described, it will be clear that the present invention is not limited to these embodiments only. Numerous modifications, changes, variations, substitutions and equivalents will be apparent to those skilled in the art, without departing from the spirit and scope of the present invention, as described in the following claims.

What is claimed is:

1. An exercise apparatus for training the body of a user in multi-directional patterns, said exercise apparatus comprising:

a support including two or more connecting points;

two elongate foot platforms adapted to be attached to and hang from said connecting points in substantially parallel side by side arrangement, each of said foot platforms being adapted for movement in a substantially horizontal X-Y plane with at least two degrees of freedom and wherein at least one connecting member extends from one foot platform to the other foot platform; and at least one elongate hanging member, connecting each of said foot platforms to at least one of said connecting points on said support, allowing said movement of said foot platforms in said X-Y plane with said at least two degrees of freedom.

2. The exercise apparatus according to claim 1, wherein said at least one hanging member is adjustable in length.

3. The exercise apparatus according to claim 1, wherein each foot platform has a vibratory mechanism to vibrate the bottom of a user's foot.

4. The exercise apparatus according to claim 3, wherein a controller is positioned on the support and frequency and duration of vibration are controlled by the controller.

5. The exercise apparatus according to claim 1, which comprises two hanging members for attaching opposite sides of each foot platform to said support.

6. The exercise apparatus according to claim 1, wherein said hanging member is a tension element selected from the group consisting of a chain, a band, a rod, a tube, a strap, a cable and a combination of at least two such tension elements.

7. The exercise apparatus according to claim 6, wherein said tension element is non-elastic.

8. The exercise apparatus according to claim 6, wherein at least a portion of said tension element is elastic, thereby supporting said foot platform with a third degree of freedom.

9. The exercise apparatus according to claim 1, wherein said tension element is flexible.

10. The exercise apparatus according to claim 1, wherein said support is substantially C-shaped and arranged in a substantially horizontal plane.

11. The exercise apparatus according to claim 1, wherein said hanging member for attaching said foot platform to said support comprises a holding bar which has a ring at one end adapted to slide over said support to form a connecting point.

12. The exercise apparatus according to claim 1, wherein the support comprises two substantially U-shaped sections arranged in a substantially horizontal plane.

13. The exercise apparatus according to claim 1, wherein the support is substantially vertical.

14. The exercise apparatus according to claim 1, wherein said hanging member for attaching said foot platform to said support has a clip at one end for attachment to said support at a connecting point.

15. The exercise apparatus according to claim 1, wherein said hanging member is easily detachable from said support.

16. The exercise apparatus according to claim 1, wherein said connecting points also allow attachment of at least one fitness accessory to said support.

17. The exercise apparatus according to claim 1, further comprising an ankle training accessory, adapted to be attached to said foot platform.

18. The exercise apparatus according to claim 17, wherein said ankle training accessory is a circular pivot plate.

19. The exercise apparatus according to claim 17, wherein said ankle training accessory is a half ball.

20. The exercise apparatus according to claim 17, wherein said ankle training accessory is a rotatable disc.

21. The exercise apparatus according to claim 17, wherein said ankle training accessory is a longitudinally extending member.

22. The exercise apparatus according to claim 17, wherein said foot platform is centrally attached to allow it to rock up and down, thereby providing ankle training.

23. The exercise apparatus according to claim 1, wherein each said connecting member is elastic, non-elastic, or a combination thereof.

24. An exercise apparatus for training the body of a user in multi-directional patterns, said exercise apparatus comprising an apparatus of claim 1 mounted on a stand.

25. An exercise apparatus for training the body of a user in multi-directional patterns, said exercise apparatus comprising:

a support including two or more connecting points and comprising two sections that can be separated, wherein one section of the support can be moved relative to the other section;

two foot platforms adapted to be attached to and hang from said connecting points in substantially parallel side by side arrangement, each of said foot platforms being adapted for movement in a substantially horizontal X-Y plane with at least two degrees of freedom; and at least one elongate hanging member, connecting each of said foot platforms to at least one of said connecting points on said support, allowing said movement of said foot platforms in said X-Y plane with said at least two degrees of freedom.

26. The exercise apparatus according to claim 25, wherein said at least one hanging member is adjustable in length.

27. The exercise apparatus according to claim 25, which comprises two hanging members for attaching opposite sides of each foot platform to said support.

28. The exercise apparatus according to claim 25, wherein each said hanging member is a tension element selected from the group consisting of a chain, a band, a rod, a tube, a strap, a cable and a combination of at least two such tension elements.

29. The exercise apparatus according to claim 28, wherein said tension element is non-elastic.

30. The exercise apparatus according to claim 28, wherein at least a portion of said tension element is elastic, thereby supporting said foot platform with a third degree of freedom.

31. The exercise apparatus according to claim 28, wherein said tension element is flexible.

32. The exercise apparatus according to claim 25, wherein said support is substantially C-shaped and arranged in a substantially horizontal plane.

33. The exercise apparatus according to claim 25, wherein the support comprises two substantially U-shaped sections arranged in a substantially horizontal plane.

34. The exercise apparatus according to claim 25, wherein the support is substantially vertical.

35. The exercise apparatus according to claim 25, wherein said hanging member for attaching said foot platform to said support has a ring at one end adapted to slide over said support to form a connecting point.

36. The exercise apparatus according to claim 25, wherein said hanging member for attaching said foot platform to said support a clip at one end for attachment to said support at a connecting point.

37. The exercise apparatus according to claim 25, wherein said hanging member is easily detachable from said support.

38. The exercise apparatus according to claim 25, further comprising an ankle training accessory, adapted to be attached to said foot platform.

39. The exercise apparatus according to claim 38, wherein said ankle training accessory is a circular pivot plate.

40. The exercise apparatus according to claim 38, wherein said ankle training accessory is a half ball.

41. The exercise apparatus according to claim 38, wherein said ankle training accessory is a rotatable disc.

42. The exercise apparatus according to claim 38, wherein said ankle training accessory is a longitudinally extending member.

43. The exercise apparatus according to claim 38, wherein said foot platform is centrally attached to allow it to rock up and down, thereby providing ankle training.

44. An exercise apparatus for training the body of a user in multi-directional patterns, said exercise apparatus comprising an apparatus of claim 24 mounted on a stand.

45. An exercise apparatus for training the body of a user in multi-directional patterns, said exercise apparatus comprising:

a support including two or more connecting points;

two elongate foot platforms adapted to be attached to and hang from said connection points in substantially parallel side by side arrangement, each of said foot platforms being adapted for movement in a substantially horizontal X-Y plane with at least two degrees of freedom;

at least one elongate hanging member, connecting each of said foot platforms to at least one of said connecting points on said support, allowing said movement of said foot platforms in said X-Y plane with said at least two degrees of freedom; and at least one limiter to limit the swinging or rotational movement of an upper portion of each hanging member.

46. The exercise apparatus according to claim 45, wherein said at least one handing member is adjustable in length.

47. The exercise apparatus according to claim 45, which comprises two hanging members for attaching opposite sides of each foot platform to said support.

48. The exercise apparatus according to claim 45, wherein said hanging member is a tension element selected from the group consisting of a chain, a band, a rod, a tube, a strap, a cable and a combination of at least two such tension elements.

49. The exercise apparatus according to claim 48, wherein said tension element is non-elastic.

50. The exercise apparatus according to claim 48, wherein at least a portion of said tension element is elastic, thereby supporting said foot platform with a third degree of freedom.

51. The exercise apparatus according to claim 48, wherein said tension element is flexible.

52. The exercise apparatus according to claim 45, wherein said support is substantially C-shaped and arranged in a substantially horizontal plane.

53. The exercise apparatus according to claim 45, wherein the support comprises two substantially U-shaped sections arranged in a substantially horizontal plane.

54. The exercise apparatus according to claim 45, wherein the support is substantially vertical.

55. The exercise apparatus according to claim 45, wherein said hanging member for attaching said foot platform to said support comprises a holding bar which has a ring at one end adapted to slide over said support to form a connecting point.

56. The exercise apparatus according to claim 45, wherein said hanging member for attaching said foot platform to said support has a clip at one end for attachment to said support at a connecting point.

57. The exercise apparatus according to claim 45, wherein said hanging member is easily detachable from said support.

58. The exercise apparatus according to claim 45, wherein said connecting points also are adapted to attach at least one fitness accessory to said support.

59. The exercise apparatus according to claim 45, further comprising an ankle training accessory, adapted to be attached to said foot platform.

60. The exercise apparatus according to claim 59, wherein said ankle training accessory is a circular pivot plate.

61. The exercise apparatus according to claim 59, wherein said ankle training accessory is a half ball.

62. The exercise apparatus according to claim 59, wherein said ankle training accessory is a rotatable disc.

63. The exercise apparatus according to claim 59, wherein said ankle training accessory is a longitudinally extending member.

64. The exercise apparatus according to claim 59, wherein said foot platform is centrally attached to allow it to rock up and down, thereby providing ankle training.

65. The exercise apparatus according to claim 45, wherein the angle of rotation of the upper end of the hanging member is limited.

66. The exercise apparatus according to claim 65, wherein the swinging movement is limited by mechanical, hydraulic, or electrical means.

67. The exercise apparatus according to claim 45, wherein the hanging member is rigid or substantially rigid.

68. An exercise apparatus for training the body of a user in multi-directional patterns, said exercise apparatus comprising an apparatus of claim 45 mounted on a stand.

69. An exercise apparatus for training the body of a user in multi-directional patterns, said exercise apparatus comprising:

a support including two or more connecting points;

two elongate foot platforms adapted to be attached to and hang from said connecting points in substantially parallel side by side arrangement, each of said foot platforms being adapted for movement in a substantially horizontal X-Y plane with at least two degrees of freedom and wherein said foot platforms each have multi-directional wheels, rollers, or castors to support the foot platform; and at least one elongate hanging member, connecting each of said foot platforms to at least one of said connecting points on said support, allowing said movement of said foot platforms in said X-Y plane with said at least two degrees of freedom.

70. An exercise apparatus for training the body of a user in multi-directional patterns, said exercise apparatus comprising:

a support including two or more connecting points;

two elongate foot platforms adapted to be attached to and hang from said connecting points in substantially parallel side by side arrangement, each of said foot platforms being adapted for movement in a substantially horizontal X-Y plane with at least two degrees of freedom and wherein said foot platforms each have multi-directional wheels, rollers, or castors to support the foot platform;

at least one elongate hanging member, connecting each of said foot platforms to at least one of said connecting points on said support, allowing said movement of said foot platforms in said X-Y plane with said at least two degrees of freedom; and a base comprising at least one contoured surface upon which the multi-directional wheels, rollers, or castors of the foot platforms can move.

71. The exercise apparatus according to claim 70, wherein the base comprises two or more sections that fit together.

72. The exercise apparatus according to claim 70, wherein the contoured surfaces form a upwardly turned saucer shape.

73. The exercise apparatus according to claim 70, wherein the contoured surfaces form a pipeline shape.

74. An exercise apparatus for training the body of a user in multi-directional patterns, said exercise apparatus comprises:

support including two or more connecting points;

two elongate foot platforms adapted to be attached to and hang from said connecting points in substantially parallel side by side arrangement, each of said foot platforms being adapted for movement in a substantially horizontal X-Y plane with at least two degrees of freedom; and at least one elongate hanging member, connecting each of said foot platforms to at least one of said connecting points on said support, allowing said movement of said foot platforms in said X-Y plane with said at least two degrees of freedom.

75. The exercise apparatus according to claim 74, wherein the support is substantially vertical.

76. In an improved exercise apparatus comprising foot platforms suspended from a support bar, the improvement for training the body of a user in multi-directional patterns, which comprises:

support including two or more connecting points;

two elongate foot platforms adapted to be attached to and hang from said connecting points in substantially parallel side by side arrangement, each of said foot platforms being adapted for movement in a substantially horizontal X-Y plane with at least two degrees of freedom; and at least one elongate hanging member, connecting each of said foot platforms to at least one of said connecting points on said support, allowing said movement of said foot platforms in said X-Y plane with said at least two degrees of freedom.

77. The improved exercise apparatus according to claim 76, wherein the support is substantially vertical.

* * * * *